US005774838A

United States Patent [19]

Miseki et al.

[11] Patent Number: 5,774,838

[45] Date of Patent: Jun. 30, 1998

[54] SPEECH CODING SYSTEM UTILIZING VECTOR QUANTIZATION CAPABLE OF MINIMIZING QUALITY DEGRADATION CAUSED BY TRANSMISSION CODE ERROR

[75] Inventors: Kimio Miseki; Tadashi Amada, both of Kawasaki, Japan

[73] Assignee: Kabushiki Kaisha Toshiba, Kawasaki, Japan

[21] Appl. No.: 536,362

[22] Filed: Sep. 29, 1995

[30] Foreign Application Priority Data

| | | | |
|---|---|---|---|
| Sep. 30, 1994 | [JP] | Japan | 6-238142 |
| Mar. 16, 1995 | [JP] | Japan | 7-057632 |
| Mar. 23, 1995 | [JP] | Japan | 7-063659 |

[51] Int. Cl.[6] ..... G10L 3/00

[52] U.S. Cl. ..... 704/222; 704/230; 704/207

[58] Field of Search ..... 395/2.28, 2.39, 395/2.31, 2.32, 2.29, 2.09, 2.33; 704/219, 230, 222, 223, 224, 220, 200, 207

[56] References Cited

U.S. PATENT DOCUMENTS

| | | | |
|---|---|---|---|
| 5,091,945 | 2/1992 | Kleijn | 395/2.39 |
| 5,151,038 | 9/1992 | Yashikawa et al. | 375/122 |
| 5,151,968 | 9/1992 | Tamaka et al. | 395/2.09 |
| 5,230,036 | 7/1993 | Akamine et al. | 395/2.09 |
| 5,233,660 | 8/1993 | Chen | 395/2.39 |
| 5,263,119 | 11/1993 | Tamaka et al. | 395/2.32 |
| 5,495,555 | 2/1996 | Swaminathan | 395/2.16 |

FOREIGN PATENT DOCUMENTS 5-37397 2/1993 Japan .

OTHER PUBLICATIONS

Takehiro Moriya et al., Training Method of the Excitation Codebooks For CELP; IEICE Trans., vol. J77–A, No. 3, Mar. 1994, pp. 485–493.

Ira A. Gerson et al., Vector Sum Excited Linear Prediction (VSELP) Speech Coding At 8 KBPS; Proc. IEEE ICASSP, Apr. 1990, pp. 461–464.

Weidong Kou et al., Vector–Adaptive Vector Quantization with Application to Speech Coding; IEEE Transactions on Communications, vol. 39, No. 6, Jun. 1991, pp. 958–962.

Akitoshi Kataoka et al., Implementation and Performance of an 8–KBIT/S Conjugate Structure CELP Speech Coder; IEEE Proc. ICASSP 1994, pp. II–93–96.

*Primary Examiner*—Allen R. MacDonald
*Assistant Examiner*—Richemond Dorvil
*Attorney, Agent, or Firm*—Oblon, Spivak, McClelland, Maier & Neustadt, P.C.

[57] ABSTRACT

In a vector quantization apparatus for expressing a target vector by using a code vector designated by an index, an error evaluating section performs error evaluation for a code vector without considering a code error of the index and error evaluation with considering the code error, a first selecting section selects a small number of indexes from a larger number of indexes on the basis of an evaluation result without considering the code error, and a second selecting section selects, on the basis of an evaluation result with considering the code error, an index used to express the target vector from a small number of indexes selected by the first selecting section.

18 Claims, 21 Drawing Sheets

SPEECH CODING SYSTEM UTILIZING VECTOR QUANTIZATION CAPABLE OF MINIMIZING QUALITY DEGRADATION CAUSED BY TRANSMISSION CODE ERROR

BACKGROUND OF THE INVENTION

1. Field of the Invention

The present invention relates to a vector quantization apparatus used for coding speech or an image.

2. Description of the Related Art

In a vector quantization scheme, a block consisting of a plurality of samples obtained by sampling speech signals and the like is considered as one point in a multi-dimensional vector space, and the speech signals are simultaneously coded. In the vector quantization scheme, a target vector is expressed by using one of the vectors which is designated by an index. The vector quantization scheme is popularly used in a speech coding apparatus for compressing and coding speech signals for radio transmission.

According to a speech coding scheme which is represented by a recent CELP (Code-Excited Linear Prediction) scheme, the shape of the pitch component of an excitation signal serving as a speech source and the shape of a noise component are expressed by vector quantization using two codebooks, i.e., an adaptive codebook and a noise codebook, and an excitation signal obtained by combining these shapes to each other is passed through a synthesis filter having a characteristic (filter coefficient) changing with time, thereby generating a synthesized speech. In order to make the quality of the synthesized speech high, a coding section for an excitation signal performs coding such that the synthesized speech has a minimum subjective error. More specifically, an error evaluation parameter which changes with time is extracted from the input speech to select an index for designating code vectors to be extracted from the adaptive codebook and the noise codebook. Therefore, in a conventional CELP scheme, synthesized speech having relatively high quality can be produced at a low bit rate of 4 kbits/second.

However, it is known that, when the conventional CELP scheme or the like is used in a speech coding apparatus for radio mobile communication, a code error on a transmission path influences an index to be transmitted to considerably degrade the quality of the synthesized speech. When the transmission path has a poor condition, such a code error cannot be prevented even if an error correcting code is employed. Therefore, in order to provide a practical coding apparatus, it is important that a mechanism for minimizing quality degradation caused by a code error on the transmission path is incorporated in the process of coding speech.

As a conventionally known method for counter-measures against a code error in a speech coding apparatus, the following method is available. That is, a countermeasure in which redundancy is incorporated into transmitted parameter candidates serving as coding outputs in advance, a countermeasure in which the correspondence between a code vector and an index is preset to minimize degradation caused by a code error, and the like are made in a design for a coding apparatus. This method is described in, for example, "Training Method of the Excitation Codebooks for CELP" by T. Moriya et al., The Transactions of the Institute of Electronics, Information, and Communication Engineers, Vol. J77-A, No. 3, pp. 485–493, April 1994. When a coding apparatus is designed using this method, the code of index information selected by the coding apparatus is suffered by a code error on a transmission path, and a code vector reproduced by a decoding apparatus can be advantageously suppressed on average from quality degradation.

However, in the above-described speech coding apparatus, the influence of quality degradation caused by a code error on the transmission path is not considered in the step of selecting an index which is performed by the coding apparatus in its actual operation. Therefore, the error of the code vector is evaluated regardless of a code error, and an index code of the noise codebook is selected on the basis of only the evaluation value. More specifically, when a code error occurs in the code of a selected index, the magnitude of the error is not evaluated. Therefore, when a code error occurs in an index code, a large error occurs in a code vector read out on the decoding side depending on the code error, and the quality of the reproduced signal may be abruptly degraded.

Among the vector quantization schemes, as a vector quantization scheme used in speech coding having a bit rate of about 8 kbits/second, the VSELP (Vector Sum Excited Linear Prediction) scheme is known. The VSELP scheme is described in "VECTOR SUM EXCITED LINEAR PREDICTION (VSELP) SPEECH CODING AT 8 KBPS" by Ira A. Gerson et al., Proc. IEEE Int. Conf. on Acoustics, Speech and Signal Processing, pp. 461–464, April 1990.

One characteristic feature of the VSELP scheme is as follows. That is, when the number of bits of an index serving as an output code of vector quantization is p, p basis vectors stored in advance are used, and $2^p$ code vectors are expressed by combinations between the sums or differences between the p basis vectors.

More specifically, p basis vectors Vm(n) are multiplied by a coefficient θ im, and the multiplication results are added to each other to obtain a code vector Ui(n). In this case, reference symbol Vm(n) denotes the mth basis vector, reference symbol Ui(n) denotes the code vector of an index i, and the coefficient θ im is set to be +1 or −1 depending on the values i and m. In this manner, it is possible to search for the optimum index i by using a recursive equation. Therefore, when the number p of bits of the index i is about 7 to 9, a calculation amount required for vector quantization can be suppressed such that real-time processing can be performed.

However, in the conventional vector quantization scheme, the reduction of the calculation amount required for the index search is not sufficient, and the real-time processing cannot be performed when the number p of bits of the index is set to be 10 or more.

As described above, in the vector quantization apparatus using the conventional scheme, when the number of bits of the index is large, the real-time processing cannot be easily performed because of an increase in the calculation amount required for preferable index search.

In a speech coding scheme based on a linear prediction analysis method represented by a CELP scheme, an excitation signal, a gain, and a filter coefficient are used as main parameters to be transmitted.

The CELP scheme will be briefly described below. The speech coding apparatus analyzes input speech divided in units of frames to determine the filter coefficient of a weighted synthesis filter. On the other hand, two types of code vectors from the adaptive codebook and the noise codebook are calculated such that the error between weighted input speech obtained by causing the input speech to pass through a perceptional weighting section and decoded speech output from the weighted synthesis filter is minimized, and gains by which the code vectors are to be multiplied are obtained. The two types of code vectors multiplied by the gains are synthesized, and the resultant vector is used as an excitation signal for the weighted synthesis filter. The information such as the excitation signal, the gains, and the filter coefficient of the synthesis filter is sent to the speech decoding apparatus as coded parameters. The speech decoding apparatus generates decoded speech on the basis of the received parameters.

In the speech coding/decoding apparatuses, it is an important problem how to reduce the information amount of the coded parameters sent from the coding apparatus. Various measures for reducing the information amount of the coded parameters are made.

For example, the excitation signal for exciting the synthesis filter is obtained by modeling a signal generated by human vocal chords, and has a characteristic feature in which the power of the excitation signal changes moderately with time. As one method of reducing the number of bits required for quantization in transmission of the index information of the gain codebook, a method using this characteristic feature is proposed. More specifically, the power of excitation signals for previous frames is stored, and the power of the code vector at the current frame is compared with the power of the stored excitation signals to predict the value of a gain. An index of the codebook indicating the difference between the prediction value and the value of the actual gain is quantized (coded) and transmitted to the decoding side, and in the decoding side the value of the actual gain is obtained by an operation opposite to the above coding operation.

However, since this method uses the information of the previous frame, the difference between the prediction of the gain and the value of the actual gain is large at the transition portions such as a rising portion, a falling portion, and a change portion of vocal of input speech; thus, effective quantization cannot be always expected.

As described above, in a conventional technique in which, in transmission of the information of a gain by which a code vector is multiplied in the speech coding/decoding apparatuses using the CELP scheme, the information of a previous frame is used when the gain is quantized to reduce the number of bits for quantizing the index information of a gain codebook, but the performance of quantization at the transition portions of an input signal is not always preferable.

SUMMARY OF THE INVENTION

The present invention has been made to cope with the above circumstances, and has as its first object to provide a vector quantization apparatus capable of minimizing abrupt quality degradation of a reproduced signal even if a code error is present on a transmission path.

It is the second object of the present invention to provide a vector quantization apparatus capable of performing a preferable index search at a high speed even if the number of bits of the index is large.

It is the third object of the present invention to provide a vector quantization apparatus which can reduce the number of bits required for quantization in transmission of a gain code vector and has excellent quantization performance in the transition portion of an input signal.

In order to achieve the first object, according to the present invention, a vector quantization apparatus for expressing a target vector by using a code vector designated by an index comprises error evaluating means for evaluating an error of the code vector and considering a code error of the index, and means for selecting, on the basis of an evaluation result of the error evaluating means, at least one index from a plurality of indexes each of which can be an index used to express the target vector.

The present invention is characterized by comprising first evaluating means for evaluating an error of a code vector, second evaluating means for evaluating the error of the code vector and considering a code error of an index, first selecting means for selecting, on the basis of an evaluation result of the first evaluating means, a small number of indexes from a plurality of indexes each of which can be an index used to express the target vector, and second selecting means for selecting, on the basis of an evaluation result of the second evaluating means, at least one index from the indexes selected by the first selecting means.

Further, the present invention is characterized by comprising input means for inputting information related to a code error on a transmission path for transmitting information of the index, and means for adjusting the degree of consideration of the code error by the second evaluating means on the basis of the information input by the input means.

The error evaluating means calculates the error of the code vector to evaluate it. However, as an error evaluating method, in addition to a method of actually calculating the error of the distance between vectors, a simple error evaluating method obtained by combining a combination of a value corresponding to the inner product between a synthesis vector and a target vector, a value corresponding to the power of the synthesis vector, and a value following these values to each other, or a method of calculating an error of the direct shape of the code vector caused by a code error without using a synthesis filter can be used.

When the present invention is applied to a speech coding apparatus using vector quantization, i.e., a speech coding apparatus based on a method of expressing synthesis speech by a synthesis filter and an excitation signal for exciting the synthesis filter and expressing a noise component of the excitation signal by using a noise code vector designated by an index, a method of selecting an index according to the present invention can be applied to the process for selecting an index used to express the noise component of the excitation signal from a large number of indexes. In this case, weighted error evaluation is performed on a code vector.

In order to achieve the second object, according to the present invention, a vector quantization apparatus for searching for an index corresponding to a desired representative vector on the basis of an error of a representative vector related to a target vector to output the index which is searched for comprises representative vector generating means for generating a representative vector having, as an element, a product between an element of an N-dimensional seed vector and an element $s_n$ of an N-dimensional polarity vector having, an element, a polarity by which the N-dimensional seed vector is multiplied, polarity information index generating means for generating a polarity information index corresponding to a polarity of each element of the polarity vector, and means for generating a polarity vector on the basis of the polarity information index.

More specifically, the representative vector generating means generates a representative vector having, as an element, a product $v_n \times |s_n|$ ($n=0$ to $N-1$ and $|s_n|=1$) between an element $v_n$ of the N-dimensional seed vector and the element $s_n$ corresponding to the N-dimensional polarity vector. In this case, in the polarity information index generating means, the polarity of the element $s_n$ of the polarity vector designated by the polarity information for designating the polarity of the element $s_n$ of the polarity vector generated by the polarity information index generating means is preferably set to be $s_k$ (k=L(p, n) (k and p are integers which satisfy $0 \leqq k \leqq p-1$ and $1 \leqq p \leqq N$)), and the polarity $s_k$ is caused to correspond to a kth bit value $b_k$ of the polarity information, thereby generating a p-bit polarity information index.

In this case, the function L(p, n) is preferably set to be a remainder obtained by dividing n by p or the maximum integer which does not exceed np/N.

Further, a partial inner product between the target vector and the representative vector is calculated with respect to an nth vector element which satisfies a condition k=L(p, n) of the seed vector, and a polarity of the partial inner product is preferably set to be the polarity $s_k$.

An extended vector quantization apparatus according to the present invention comprises seed vector storing means in which a plurality of N-dimensional seed vectors are stored, and seed vector index searching means for searching for a seed vector index for selecting one of the plurality of seed vectors stored in the seed vector storing means. In this case, a representative vector generating means generates a representative vector having, as an element, a product between an element of the N-dimensional seed vector selected by the seed vector index searching means and an element of an N-dimensional polarity vector having, as an element, a polarity by which each element of the seed vector is multiplied.

The seed vector index searching means is characterized by comprising means for decreasing the number of indexes of the seed vector to J (0<J<<I) by using the following relationship:

$$cor(i) = \sum_{k=0}^{p-1} |f_k|$$

is calculated, when a seed vector Vi (i is a seed vector index and satisfies i=0 to I−1) is used as the seed vector, on the basis of a partial inner product $f_k$ between the target vector and the code vector with respect to an nth vector element which satisfies a condition k=L(p, n) (k and p are integers which satisfy $0 \leqq k \leqq p-1$, $1 \leqq p \leqq N$ (N is an integer)) of the seed vector Vi for each vector Vi.

In order to achieve the third object, a vector quantization apparatus according to the present invention is characterized in that, in an apparatus which receives first and second input vectors in units of frames and quantizes a gain by which the second input vector is multiplied, an inverse normalizing coefficient is calculated by using the first input vector of a current frame, and a normalized gain is inversely normalized by using the inverse normalizing coefficient, thereby calculating the gain by which the second input vector is multiplied.

When the inverse normalizing coefficient is calculated, an input vector obtained by scaling the first input vector of the current frame can be used.

A vector quantization apparatus according to the present invention is characterized in that, in a vector quantization apparatus which receives first and second input vectors in units of frames and quantizes a gain by which the second vector is multiplied, a normalizing coefficient is calculated by using the first input vector of a current frame, and a gain by which the first vector is multiplied is normalized by using the normalizing coefficient.

In this case, when the normalizing coefficient is calculated, an input vector obtained by scaling the first input vector of the current frame can be used.

According to the present invention, there is a speech coding apparatus in which an adaptive code vector and a noise code vector respectively obtained from an adaptive codebook and a noise codebook are synthesized with each other after the adaptive code vector and the noise code vector are multiplied by respective gain vectors obtained from a gain codebook, a synthesized vector is supplied, as an excitation signal, to a synthesis filter having a filter coefficient determined on the basis of an analysis result of an input speech signal in units of frames, the adaptive codebook, the noise codebook, and the gain codebook are searched for an adaptive code vector, a noise code vector, and a gain code vector such that an error between a speech signal output from the synthesis filter and a perceptional weighted signal of the input speech signal is minimized, and the adaptive code vector, the noise code vector, the gain vector obtained from the gain codebook, and the filter coefficient of the synthesis filter are output as coding parameters respectively representing the adaptive code vector, the noise code vector, the gain vector, and the filter coefficient, wherein the apparatus comprises calculating means for calculating an inverse normalizing coefficient by using the adaptive code vector of a current frame obtained from the adaptive codebook, inverse normalizing means for inversely normalizing a normalized gain by using the inverse normalizing coefficient calculated by the calculating means to obtain a gain by which the second vector is multiplied, and means for outputting a coding parameter representing the normalized gain.

According to the present invention, there is a speech decoding apparatus in which an adaptive code vector and a noise code vector obtained from an adaptive codebook and a noise codebook are synthesized with each other after the adaptive code vector and the noise code vector are respectively multiplied by gain vectors obtained from a gain codebook, a synthesized vector is supplied, as an excitation signal, to a synthesis filter having a filter coefficient determined on the basis of an analysis result of an input speech signal in units of frames, a speech signal from the synthesis filter is decoded, wherein the apparatus comprises calculating means for calculating an inverse normalizing coefficient by using the adaptive code vector of a current frame obtained from the adaptive codebook, and inverse normalizing means for inversely normalizing a normalized gain by using the inverse normalizing coefficient calculated by the calculating means to obtain a gain by which the noise code vector is to be multiplied.

Additional objects and advantages of the present invention will be set forth in the description which follows, and in part will be obvious from the description, or may be learned by practice of the present invention.

The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

A preferred embodiment of a vector quantization apparatuses according to the present invention will now be described with reference to the accompanying drawings.

FIRST EMBODIMENT

Figure 1:
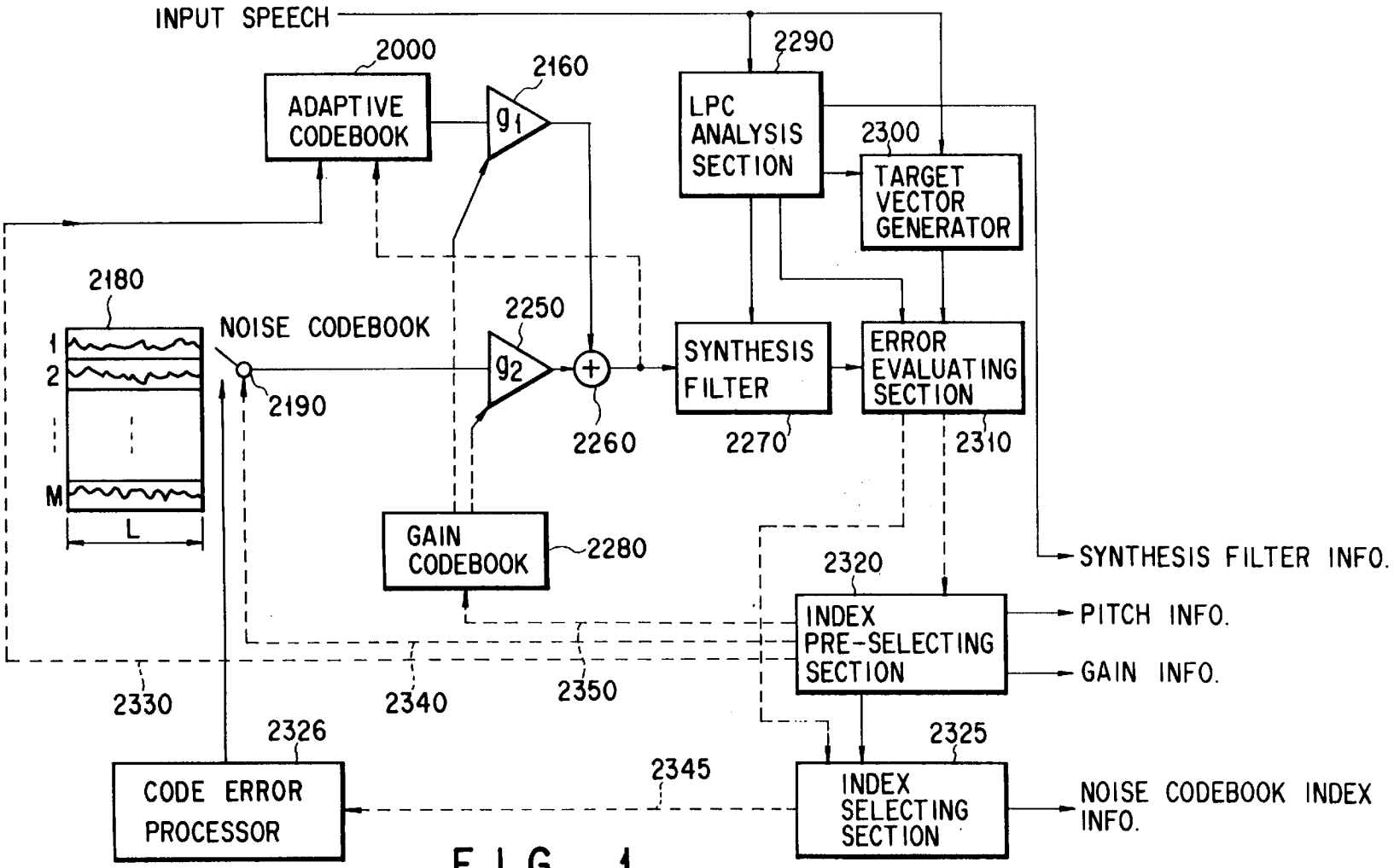
FIG. 1 is a block diagram showing a vector quantization apparatus according to the present invention on a coding apparatus side of the first embodiment.

FIG. 1 is a block diagram of a speech coding apparatus according to the first embodiment of the present invention to which a vector quantization apparatus is applied. This embodiment describes an example wherein the present invention is applied to a speech coding apparatus using a speech coding scheme represented by a CELP scheme having the following schematic arrangement.

That is, four items of information, i.e., synthesis filter coefficient information, pitch information, the index information of a noise codebook, and the index information of a gain codebook are extracted from input speech, and the pitch information, index information of the noise codebook, and the index information of the gain codebook are coded to decrease an error of synthesis speech (the error between the synthesis speech and a target vector). The items of coded information are transmitted together with the synthesis filter coefficient information.

In this embodiment, as will be described later, the search for an index of a random codebook is performed by a method unique to the present invention. Prior to the detailed description of the arrangement in FIG. 1, procedures for searching for the index of the noise codebook according to the present invention will be described below with reference to FIG. 2.

In step S0, a target vector is set on the basis of input speech.

In step S1, the error of synthesis speech is evaluated without considering a code error, and index candidates of the noise codebook are selected, i.e., indexes representing a proper number of code vector candidates each of which can be used as the target vector. For example, code vectors are arranged in order of magnitude of errors, and, among the code vectors, a predetermined number of code vectors each having the minimum error are sequentially selected.

In step S2, error evaluation with consideration of quality degradation caused by a code error is performed to the number of indexes selected as described above. In step S3, one index for finally generating a target vector is determined.

The arrangement in FIG. 1 will be described below. A speech coding apparatus according to this embodiment comprises an adaptive codebook 2000 for storing past excitation signals obtained a predetermined time ago and for generating a code vector according to a designated pitch, and a noise codebook 2180 for storing predetermined various excitation signals (noise code vectors) and for generating a noise code vector according to a noise codebook index. After gain circuits 2160 and 2250 give gains $g_1$ and $g_2$ to the code vectors obtained by the codebooks 2000 and 2180, respectively, an adder 2260 adds the code vectors to each other, and the resultant code vector is supplied to a synthesis filter 2270 as an excitation signal. These gains are given by a gain codebook 2280. The synthesis filter 2270 receives the excitation signal to output synthesis speech. On the other hand, input speech is input to an LPC (Linear Prediction Coding) analysis section 2290. The LPC analysis section 2290 analyzes the input speech to extract and encode the coefficient information of the synthesis filter representing the external shape of the spectrum of the input speech, gives the coefficient information to a target vector generator 2300 as synthesis filter coefficient information, and gives the coefficient of the synthesis filter to the synthesis filter 2270. As a method of analyzing the synthesis filter information, for example, an LPC method can be used.

The target vector generator 2300 generates a target vector on the basis of the input speech and the synthesis filter information, and outputs the target vector to an error evaluating section 2310. The error evaluating section 2310 uses the target vector and the synthesis filter coefficient information to evaluate an error of the target vector with respect to the synthesis speech obtained by the synthesis filter 2270. An output from the error evaluating section 2310 is supplied to an index pre-selecting section 2320 and an index selecting section 2325. The index pre-selecting section 2320 selects code vector candidates (index candidates) of the noise codebook 2180 on the basis of the error evaluation value obtained by the error evaluating section 2310, and gives the selection result to the index selecting section 2325. Among a small number of index candidates selected by the index pre-selecting section 2320, the index selecting section 2325 selects the optimum index of the noise codebook in consideration of a code error. Since the code error must be considered, a code error processor 2326 for giving a simulated code error on a transmission path or a recording medium to the output index from the index selecting section 2325 is connected between the index selecting section 2325 and the noise codebook 2180.

The components in FIG. 1 will be described below in detail.

The adaptive codebook 2000 is used to select a pitch. That is, the adaptive codebook 2000 stores previous excitation signals, and selects a pitch used as a coded parameter from pitches which are set in advance. More specifically, using an evaluation reference to minimize an error between the target vector generated by the target vector generator 2300 and a synthesis vector candidate obtained by causing the synthesis filter 2270 to synthesize the code vector obtained by giving the pitch to the adaptive codebook 2000, the index pre-selecting section 2320 selects the optimum pitch.

As a method of calculating an error, a method of actually calculating an error of the distances between the target vector and the synthesis vector may be used. However, the optimum pitch can be selected by the following method. That is, by modifying the equation for error calculation, a value corresponding to the inner product between the synthesis vector and the target vector and a value corresponding to the power of the synthesis vector, etc., are combined with each other to avoid repeatedly calculating a value to be fixed to any pitch, so that the magnitudes of the errors can be checked with a lesser calculation amount.

In the search of the adaptive codebook 2000, a codebook searching method is used which is equivalent to a method used to set the gain of the gain circuit 2160 to be the optimum gain used in a conventional CELP scheme. In this case, the influence to the excitation signal caused by the code vector extracted from the noise codebook 2180 is considered as zero, and the search for a pitch is performed. If the number of index candidates of the noise codebook can be limited to a very small number, the search for a pitch is performed in consideration of the influence to the excitation signal caused by the code vector from the noise codebook 2180. In this case, a pitch and a noise code which can generate synthesis speech having a lesser error can be expected.

Figure 2:
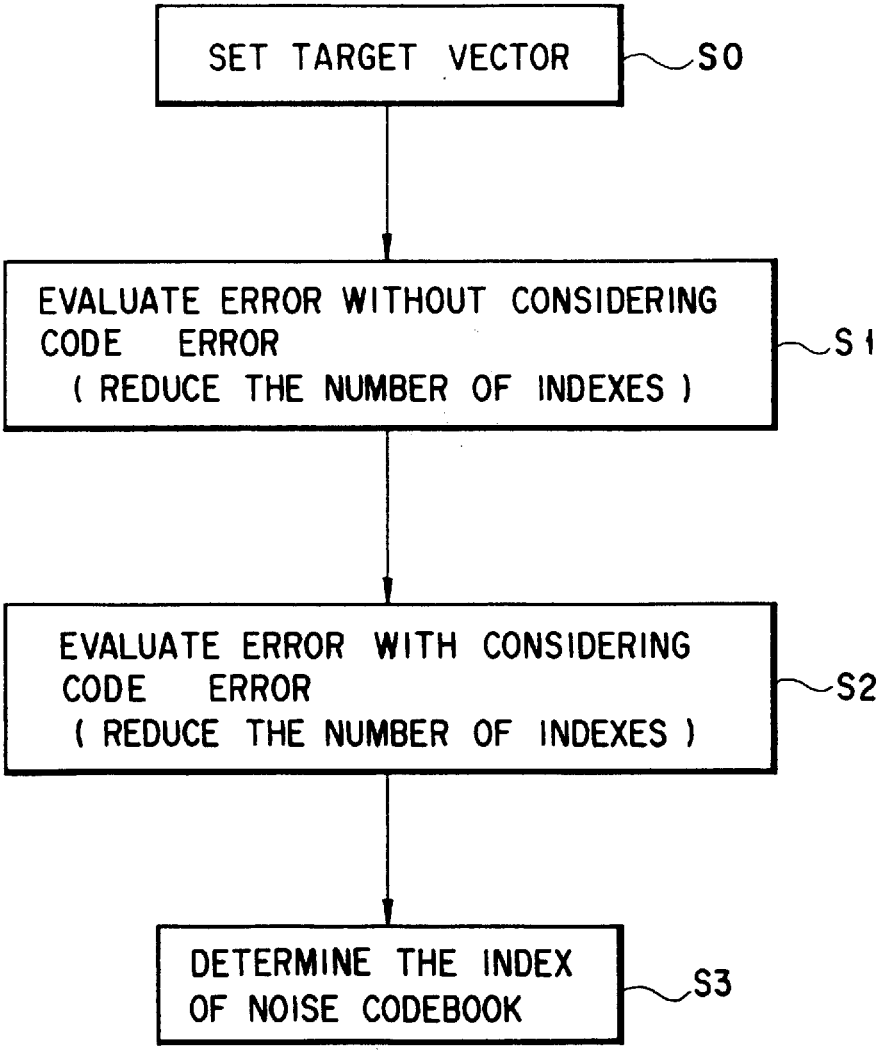
FIG. 2 is a flow chart showing code selecting processing of the first embodiment.

Procedures for searching an index of the noise codebook will be described below with reference to the flow chart shown in FIG. 2. In the search for the index of the noise codebook described in the following description, vector quantization according to the present invention is applied. In this case, the error evaluating section 2310 performs the first evaluation in which an error of the code vector is evaluated without considering a code error of an index of the noise codebook and the second evaluation in which the error of the code vector is evaluated with considering a code error of an index of the noise codebook.

That is, first the error evaluating section 2310 calculates an error evaluation result obtained when the index information of the noise codebook 2180 is free from a code error, and the index pre-selecting section 2320 selects a small number of index candidates of the noise codebook from among a large number of index candidates of the noise codebook which are set in advance on the basis of the error evaluation result. The error evaluating section 2310 calculates an error evaluation result with consideration of the code error of the index information of the noise codebook 2180, and, on the basis of the error evaluation result, the index selecting section 2325 decreases the number of index candidates of the nose codebook 2180 which are selected by the index pre-selecting section 2320, thereby searching for the optimum index of the noise codebook 2180 used to express an excitation signal.

More specifically, the index pre-selecting section 2320 uses a search loop 2340 to give index candidates to the noise codebook 2180, and, uses an evaluation reference to minimize an error between the target vector generated by the target vector generator 2300 based on the input speech and a synthesis vector candidate obtained by causing the synthesis filter 2270 to synthesize the code vector corresponding to the index candidate of the noise codebook 2180, selects a small number of index candidates of the noise codebook 2180. As a method of calculating the error used at this time, a method of actually calculating the error of the distances between vectors. However, a value corresponding to the inner product between the synthesis vector and the target vector, a value corresponding to the power of the synthesis vector, or a value following the above values are combined to each other by modifying the equation for error calculation to avoid repeatedly calculating a value to be fixed to any pitch, so that index candidates of the noise codebook having smaller errors can be selected with a lesser calculation amount.

The index selecting section 2325 selects a smaller number of index candidates from a small number of index candidates of the noise codebook 2180 which are selected by the index pre-selecting section 2320. In this embodiment, the index selecting section 2325 selects only one index from a small number of index candidates of the random nose codebook 2180, and the index information of the noise codebook 2180 to be transmitted is finally obtained. In this case, the calculation for the error evaluation value used in the error evaluating section 2310 can use an evaluation method equal to that used in the condition without considering a code error. However, in order to further simplify the calculation, the index can be effectively selected by a method such as a method which does not use the synthesis filter 2270 but uses the error of the direct shape of a code vector caused by a code error.

The code error processor 2326 simulates the code error on a transmission path or a recording medium for each of a small number of index candidates of the noise codebook 2180 selected by the index selecting section 2325, and the index is supplied to the noise codebook 2180 such that it is possible to evaluate the error of the code vector obtained when the index is changed by the code error.

The method of evaluating the error of the code vector in consideration of the code error on the transmission path or the recording medium, is performed by using the following expected value E of the error.

$$E(i) = \sum_j p(j|i)d(j) \quad (1)$$

In this case, E(i) is an expected value of an error obtained when a code corresponding to an index i is transmitted, p(j|i) is a probability of causing the code error on the transmission path or the recording medium to change the index i into an index j, and d(j) is an error evaluation value obtained when the code vector corresponding to the index j is free from a code error, or a simplified error evaluation value. For example, if the code, on the transmission path or the recording medium, corresponding to the index i is expressed by n bits, the probability that one of the n bits has an error is $\epsilon = p(j|i)$ $(i \neq j)$, and the probability that the n bits have no error is $1-n\ \epsilon = p(i|i)$.

Among a small number of index candidates of the noise codebook 2180 which are selected by the index selecting section 2325, the index i which gives an expected value having the optimum magnitude is selected as one of the index candidates of the noise codebook 2180. When the error evaluation value is defined such that d represents an error amount, E represents the expected value of the error amount. Therefore, an index obtained when E becomes minimum is preferably selected.

The following methods are effective to simplify calculation for the expected value E. That is, the value of p is quantized to be zero when the value of the probability p(j|i) is a threshold value or less, and equation (1) is not calculated when p=0; the value of p is quantized to be $(1/2)^n$ (n is a natural number) to simplify the calculation when a fixed-point DSP (digital signal processor) is used. In this case, it is assumed that the value of p(j|i) in equation (1) is given in advance.

Note that the definition of the expected value E of the error of equation (1) is also described in "Training Method of the Excitation Codebooks for CELP" by T. Moriya et al., The Transactions of the Institute of Electronics, Information, and Communication Engineers, Vol. J77-A, No. 3, pp. 485–493, April 1994, which is described above. In this paper, the expected value E is considered in only design for a codebook, the search for an index in actual coding uses an error evaluation value obtained without considering a code error on a transmission path or a recording medium.

In contrast to this, the present invention is considerably different from the above-mentioned paper in that an evaluation method which considers a code error on a transmission path or a recording medium is incorporated in an index search. In this manner, since an index can be selected such that the quality of a reproduced signal actually decoded under the condition wherein a code error is present is incorporated in the evaluation of the index, the probability of abrupt degradation of quality caused by the code error can be minimized.

One method of calculating an expected value E(i) of an error in the arrangement of the speech coding apparatus shown in FIG. 1 is as follows. That is, when the code error processor 2326 supplies the index j having a probability p(j|i) which is not negligible instead of the index i supplied from the index selecting section 2325 to the noise codebook 2180 as one of index candidates, error evaluation values obtained for code vectors corresponding to the index j are weighted with respective probabilities. The resultant error evaluation values are summed up.

When the following arrangement is used as another method of calculating the expected value E(i), the code error processor 2326 in FIG. 1 is not required. That is, the index pre-selecting section 2320 temporarily stores error evaluation values d for index candidates in a memory, the error evaluation values d required for a small number of index candidates selected by the index pre-selecting section 2320 are read from the memory, and the expected values of the error evaluation values are calculated by the index selecting section 2325.

When the index searching method described above is used, an index finally selected on the coding apparatus side can provide tone quality higher than a predetermined tone quality in the absence of a code error, and tone quality is degraded little even if an error is present. Therefore, even if a code error actually occurs on the transmission path or the recording medium, the probability that quality degradation abruptly occurs on the decoding apparatus side can be minimized.

Figure 3:
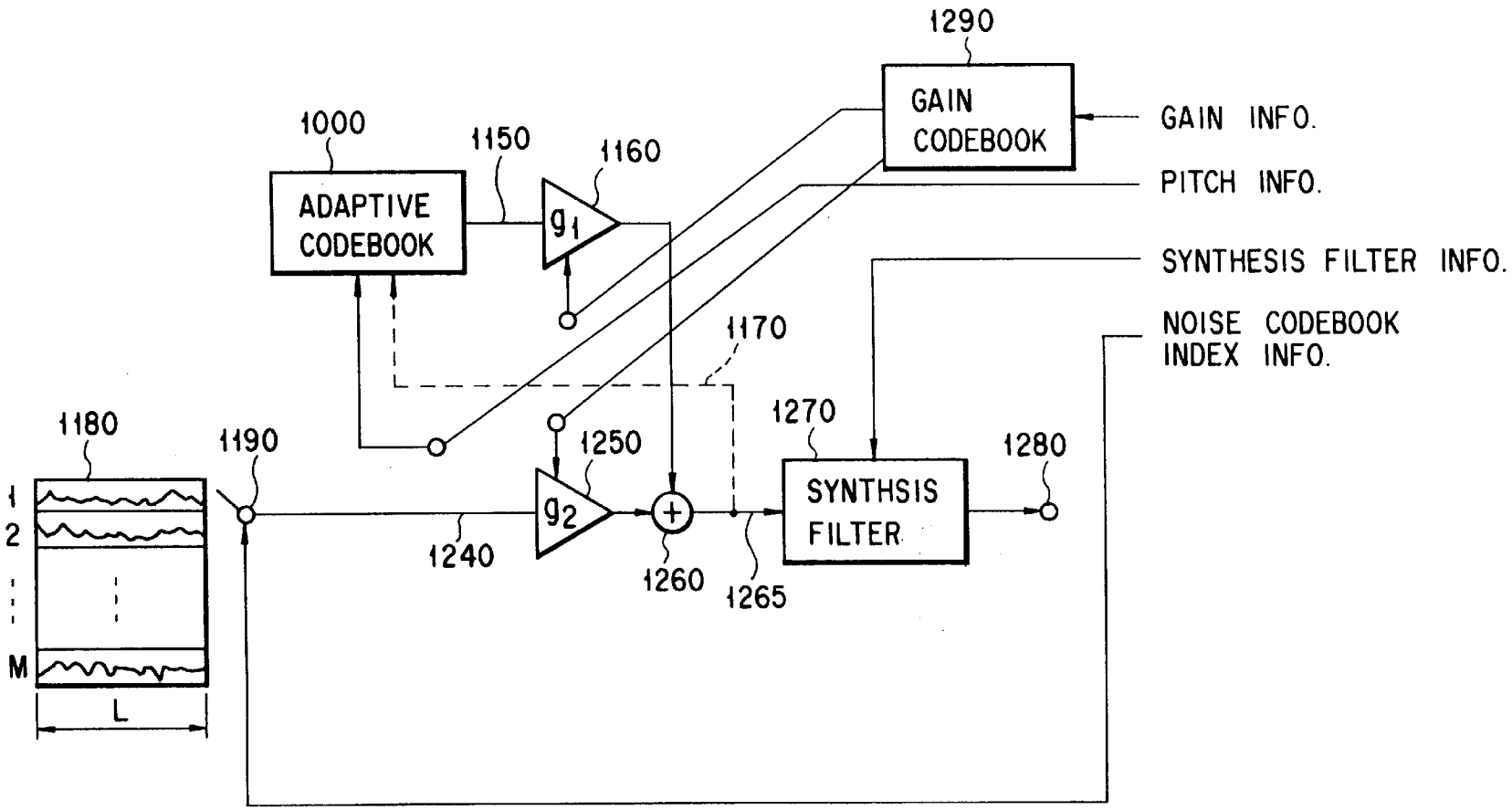
FIG. 3 is a block diagram on a decoding apparatus side of the first embodiment.

A speech decoding apparatus for reproducing coded speech on the basis of coding information generated by the speech coding apparatus described above will be described below. FIG. 3 is a block diagram showing a speech decoding apparatus according to an embodiment of the present invention. FIG. 3 shows an arrangement which receives synthesis filter information, pitch information, index information of a noise codebook 2180, and index information of a gain codebook 2280 which serve as parameters coded by the speech coding apparatus shown in FIG. 1 and generate synthesis speech on the basis of the items of information.

A method of reproducing an excitation signal will be described first. In an adaptive codebook 1000, a proper adaptive code vector selected from previous excitation signals is obtained on the basis of the pitch information transmitted from the speech coding apparatus. A gain circuit 1160 multiplies the adaptive code vector by an adaptive code vector gain $g_1$ obtained by a gain codebook 1290 on the basis of the index information of the gain codebook transmitted from the speech coding apparatus to form a first vector.

A noise code vector is extracted from a noise codebook 1180 on the basis of the index of the noise codebook 1180 transmitted from the speech coding apparatus, and a gain circuit 1250 multiplies the noise code vector by a noise code vector gain $g_2$ obtained from the gain codebook 1290 to form a second vector.

An adder 1260 reproduces, as an excitation signal, a vector obtained by adding the first and second vectors to each other. Finally, a synthesis filter 1270 constituted on the basis of the synthesis filter coefficient information transmitted from the speech coding apparatus receives the excitation signal to perform speech synthesizing, and the resultant synthesis speech is obtained from an output terminal 1280.

As described above, according to the first embodiment, on the basis of the error evaluation result of a code vector obtained with consideration of the code error of an index, a desirable index is selected from a large number of index candidates each of which can be used to express a target vector. Therefore, even if the selected index has a code error, the probability that the quality of the reproduced signal is abruptly degraded considerably decreases.

A small number of index candidates are selected from a large number of index candidates on the basis of the error evaluation result of the code vector, thereby selecting, among all the index candidates, a small number of index candidates each of which can assure quality higher than a predetermined quality and has a small error with respect to a reproduced signal obtained in the absence of a code error. Error evaluation with consideration of the influence of the code error of the index information is performed to each of a small number of index candidates, and the number of index candidates is decreased on the basis of the error, thereby selecting index candidates each having quality which is degraded little in the presence of a code error. Finally, an index used to express a target vector is selected.

The error evaluation with consideration of the influence of a code error generally requires complex calculation. However, according to the present invention, since the error evaluation with consideration of an error is performed after the number of index candidates is decreased by error evaluation without consideration of a code error, an index which can stably suppress quality degradation with respect to a code error on a transmission path or a recording medium with almost no increase in calculation amount can be selected.

In addition, according to this embodiment, a coding apparatus very resistant to code error can be provided by changing a code searching method on a coding side. Therefore, when the present invention is to be applied to a coding scheme which has been standardized, it is advantageously unnecessary to update a table such as a codebook.

Other embodiments of the vector quantization apparatus according to the present invention will be described. The same portions as those of the first embodiment will be indicated in the same reference numerals and their detailed description will be omitted.

SECOND EMBODIMENT

Figure 4:
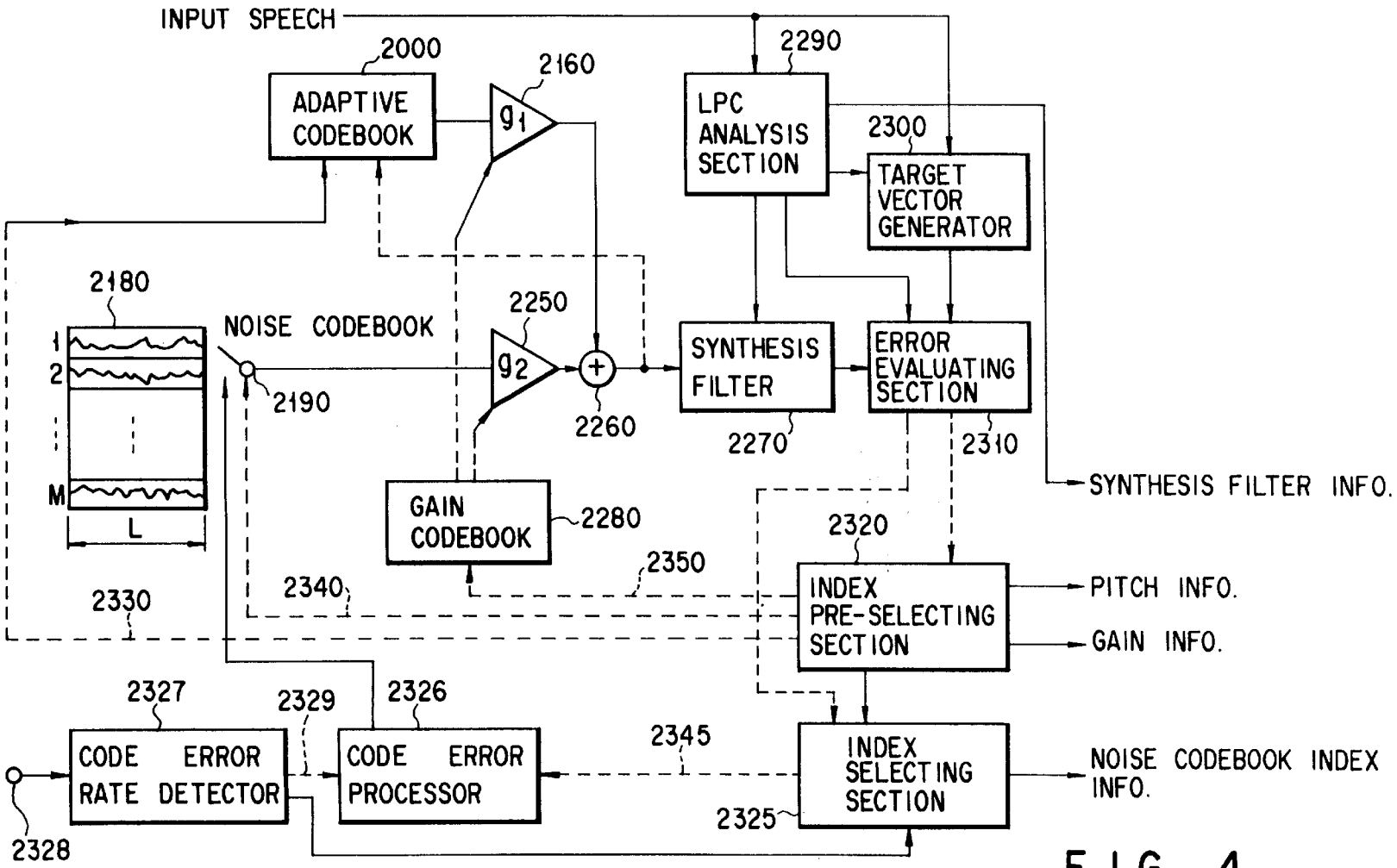
FIG. 4 is a block diagram showing a vector quantization apparatus according to the second embodiment on a coding apparatus side of the second embodiment.

FIG. 4 shows the second embodiment of the present invention in which a vector quantization apparatus is applied to a speech coding apparatus having a mechanism which can obtain information related to a code error on a transmission path or a recording medium, or a speech coding apparatus used in a radio communication system capable of providing information related to a code error on a transmission path or a recording medium to a coding apparatus side.

In the first embodiment, a code error which is predicted in advance is used, i.e., a fixed value is used for each transmission path or each recording medium. However, the second embodiment employs the following arrangement. That is, a code error rate detector 2327 obtains information related to a code error on a transmission path or a recording medium from a terminal 2328 to detect the presence/absence of a code error or the state of a code error, and an index selecting section 2325 receives a command for changing and setting, depending on the condition of the code error, the value of a probability p(j|i) of the code error of an index used for calculation of an expected value E of an error.

In this manner, the more accurate expected value of the error depending on the code error rate of the transmission path or the recording medium can be obtained, and an index which is most proper for the situation can be advantageously selected. For example, when information representing the absence of a code error is obtained during transmission or recording/reproducing, the degree of consideration of the code error is decreased, or an index search is performed on the basis of error minimization without considering the code error. When information representing the presence of a large number of code errors is obtained, it can be easily realized that the above index search is switched to index search in which the degree of consideration of the code error is made high.

In the search for an index of a noise codebook 2180, a codebook searching method can be used which is equivalent to a codebook searching method in which the gain of a gain circuit 2250 is set to be the optimum gain used in, e.g., the known CELP scheme.

In this embodiment, the index information of the gain codebook is coded by using a gain codebook 2280 capable of designating a specific gain on the basis of the index information of the gain codebook, and a search loop 2350. The search for the index information of the gain codebook is performed such that the error between synthesis speech and input speech decreases.

In this embodiment, as in the first embodiment described above, an index pre-selecting section 2320 temporarily stores error evaluation values d(j) for index candidates in a memory, the error evaluation values d(j) required for a small number of index candidates selected by the index pre-selecting section 2320 are read from the memory, and the expected values of the error evaluation values are calculated by the index selecting section 2325. In this arrangement, a code error processor 2326 is not required. In addition, a speech decoding apparatus for the speech coding apparatus may have the arrangement shown in FIG. 3.

As described above, according to the second embodiment, in addition to the effect of the first embodiment, the following effect can be obtained. That is, a radio communication system or a coding apparatus having a mechanism which can obtain information related to the code error on a transmission path or a recording medium, the degree of consideration of the influence of the code error in error evaluation with consideration of the code error is changed depending on the information related to the code error on the transmission path or the recording medium, and the index which is proper for the condition of a code error on a communication path and can obtain a reproduced signal having a small error can be selected. In addition, according to the second embodiment, vector quantization very resistant to the code error on the transmission path or the recording medium can be performed.

Note that, in the process of selecting an index in each of the first and second embodiments, the number of index candidates is decreased by error evaluation in the absence of a code error first, and the decreased number of index candidates is further decreased by error evaluation with consideration of quality degradation caused by a code error. However, if a codebook has a small size, i.e., the number of all index candidates is initially small, it is apparent that a method of selecting an index by error evaluation with consideration of quality degradation caused by the code error from the beginning (i.e., step S3 is executed from the beginning without executing step S1 in FIG. 2) is effective to realize the coding apparatus very resistant to a code error on a transmission path. It is only to reduce a calculation amount and a calculation time that the optimum index is obtained under the condition wherein a code error is present after the number of index candidates is reduced in the absence of a code error in step S2.

In the process of selecting an index in each of the first and second embodiments, the number of index candidates is decreased by error evaluation in the absence of a code error first, and one index is selected from a reduced number of index candidates by error evaluation with consideration of quality degradation caused by a code error. However, after the number of index candidates is decreased in the later decrease step, among the plurality of resultant index candidates, one index may be finally selected on the basis of other error evaluation results such as an error evaluation result in another period of a speech signal and an error evaluation result with consideration of a gain.

In addition, each of the first and second embodiments describes an example wherein vector quantization according to the present invention is applied to the search for an index of a noise codebook. The present invention is not limited to the first and second embodiments, and the present invention can be basically applied to a coding portion of a parameter to which vector quantization can be applied.

THIRD EMBODIMENT

An embodiment in which a calculation amount required for index search can be considerably reduced and real-time processing can be easily realized will be described below.

Figure 5:
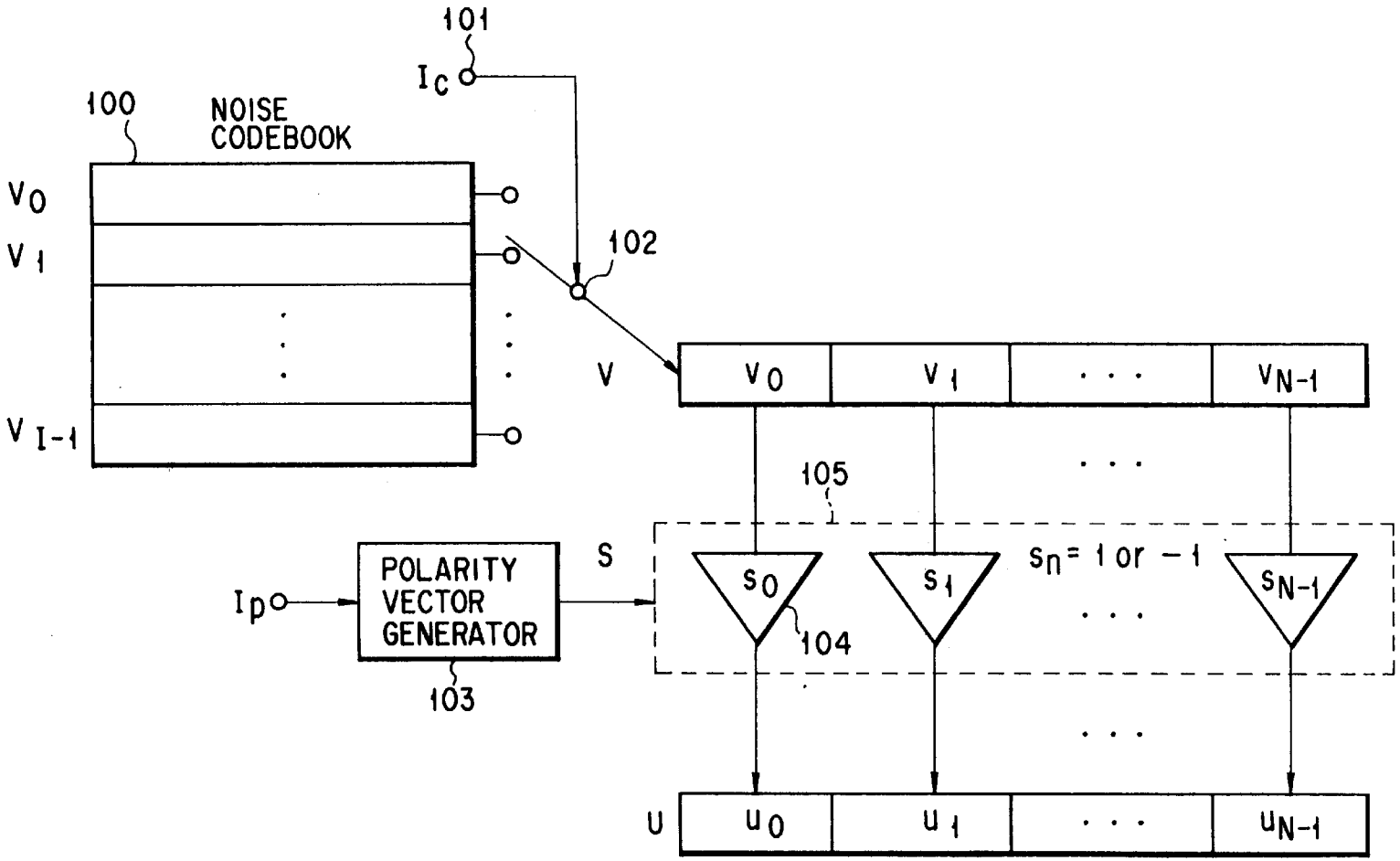
FIG. 5 is a principal block diagram showing the third embodiment of a vector quantization apparatus according to the present invention.

FIG. 5 is a view showing the principle arrangement of a noise code vector generator in a vector quantization apparatus according to the present invention. In this embodiment, a codebook 100 is a noise codebook and stores a plurality number (I) of N-dimensional seed vectors V as noise code vectors. The I N-dimensional seed vectors are represented by Vi (i=0 to I−1). An index Ic for selecting a seed vector is input to a terminal 101, one of the I seed vectors Vi is selected by a seed vector selecting switch 102 in accordance with the index Ic.

A polarity vector generator 103 generates an N-dimensional polarity vector S on the basis of a polarity information index Ip. A polarity multiplier 105 constituted by N multipliers 104 multiplies N elements $v_n$ (n=0 to N−1) of the seed vector V selected by the seed vector selecting switch 102 by N elements $s_n$ of the polarity vector S generated by the polarity vector generator 103 to generate a representative vector U having the product of vn×sn as an element $u_n$.

When such a vector reproducing section is used in the vector quantization apparatus, even if the number of bits of the representative vector index is large, the search for the optimum representative vector index can be performed at a high speed with a small calculation amount. Therefore, the vector reproducing section is suitable for real-time processing. This effect will be described below by using a concrete example. For example, it is considered that speech data obtained in 8 kHz sampling is vector-quantized by using a codebook in which $2^{20}$ (≠1,048,576) representative vectors (80 dimensions) are expressed by 20-bit information.

In this case, $2^{20}$ representative vectors can be expressed by pairs of sums or differences between 20 seed vectors in a conventional VSELP scheme. However, in order to search for a preferable representative vector of the $2^{20}$ representative vector, an error amount calculation loop is repeated $2^{19}$ times. The representative vector search using a large number of loop times requires an enormous calculation amount of about 1,000 MIPS.

In contrast to this, according to this embodiment, the element of one seed vector is divided into 20 periods, and the vector element in each period is multiplied by a polarity of +1 or −1. In this case, $2^{20}$ representative vectors can be expressed by combining items of polarity information to each other without calculating the sums or differences between vectors. Since the polarity of each period has 1 bit, only one representative vector can be reproduced by 20-bit information. The polarity of a preferable representative vector can be determined by performing a simple calculation of the inner product of the vector once and performing polarity determination 20 times. Therefore, the calculation amount is 1/10 MIPS or less.

Further, according to this embodiment, $2^{20}$ representative vectors can be expressed by an arrangement in which 2 bits are used to select four seed vectors, and 18 bits are used for polarity information. In this method, calculation of the inner product of a vector must be performed 4 times, and an error calculation loop must be repeated 4 times to search for a preferable seed vector. However, the calculation amount is about 1 MIPS.

As is apparent from the above examples, according to the present invention, even if the number of seed vectors is made smaller than the number of seed vectors used in the conventional method, a 20-bit codebook can be realized. Therefore, a memory capacity required to store seed vectors can be advantageously saved.

In addition, according to this embodiment, if the polarity information is degraded due to a code error on a transmission path or a storage medium, a representative vector having small degradation can be advantageously reproduced. This is because 1-bit polarity information influences the polarity of only a portion of the representative vector. As a result, the error of the 1-bit polarity information does not degrade the whole shape of the representative vector, but partially degrades the shape of the representative vector. Therefore, the vector quantization apparatus according to this embodiment has an advantage in having high resistance to the code error of the polarity information.

Figure 6:
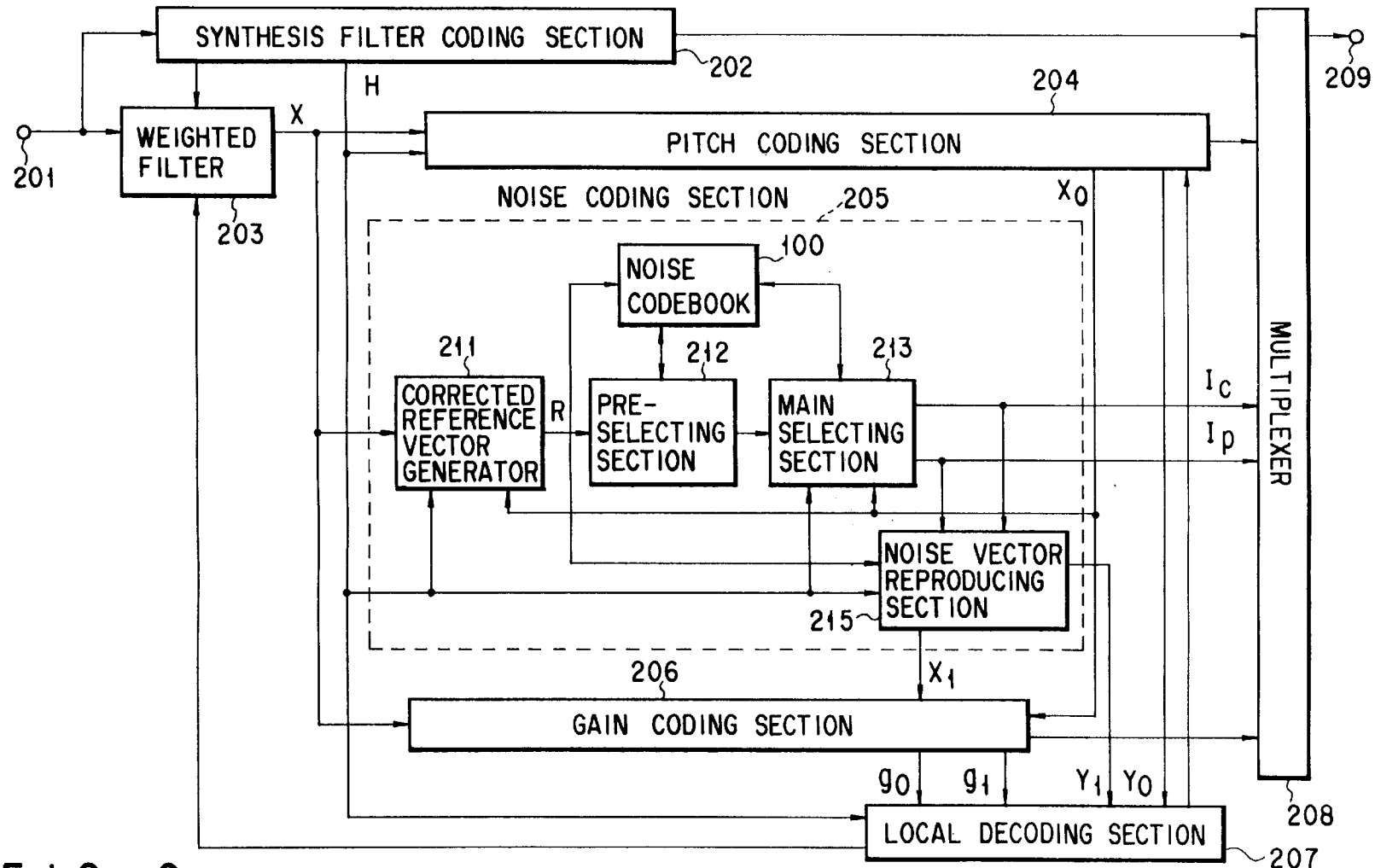
FIG. 6 is a block diagram showing a speech coding apparatus according to the third embodiment of the present invention.

An embodiment in which the vector quantization apparatus of the present invention is applied to a speech coding apparatus will be described below. FIG. 6 is a block diagram showing an arrangement of a coding apparatus when vector quantization according to the present invention is applied to a coding of a noise component of an excitation signal for speech coding.

An input signal is input from a terminal 201 to a synthesis filter coding section 202 and a weighted filter 203. The synthesis filter coding section 202 analyzes (LPC analysis or the like) an input speech signal to extract the items of information of a synthesis filter representing the spectral envelope information of input speech, codes the extracted items of information, and outputs the resultant codes to a multiplexer 208. The synthesis filter coding section 202 analyzes the input speech signal to calculate weighted filter coefficient information, outputs the weighted filter coefficient information to the weighted filter 203, and outputs weighted synthesis filter coefficient information H to a pitch coding section 204, a noise coding section 205, and a local decoding section 207.

The weighted filter 203 receives the weighted filter coefficient information, the input speech signal and a local decoding signal from the local decoding section 207 to output an N-dimensional reference speech vector X which can be processed in units of blocks.

The pitch coding section 204 receives the reference speech vector X, the weighted synthesis filter coefficient information H, and a previous excitation signal from the local decoding section 207 and performs adaptive codebook search of the known method to extract a pitch vector $Y_0$ used to reproduce the pitch component at a current point (current frame) from the waveform of the previous excitation signal. The pitch coding section 204 outputs the index of the pitch vector $Y_0$ to the multiplexer 208 and outputs a synthesized pitch vector $X_0$.

The noise coding section 205 which is the characteristic feature of this embodiment will be described below. The noise coding section 205 comprises a noise codebook 100, a corrected reference vector generator 211, a pre-selecting section 212, a main selecting section 213, and a noise vector reproducing section 215.

The corrected reference vector generator 211 weights a residual vector obtained by removing the influence of the pitch vector $X_0$ from the reference speech vector X by the weighted synthesis filter coefficient information H in the reverse order of time so as to output a corrected reference vector R. The pre-selecting section 212 uses the reference vector R and the noise codebook 100 to select a small number (J) of index candidates from a large number of index candidates of the codebook. The main selecting section 213 more accurately selects a smaller number of index candidates from the J index candidates from the pre-selecting section 212, and performs processing in which one index is finally selected as the index Ic.

The noise vector reproducing section 215 is arranged as shown in FIG. 5, and calculates, as a noise code vector $Y_1$ having the optimum shape, a representative vector U obtained by multiplication of each of the elements using the seed vector V from the noise codebook 100 corresponding to the seed vector index Ic from the main selecting section 213 and the polarity vector S corresponding to a polarity information index Ip from the main selecting section 213. In addition, the noise vector reproducing section 215 uses the nose code vector $Y_1$ and the weighted synthesis filter coefficient information H from the synthesis filter coding section 202 to output a synthesized noise code vector $X_1$.

Each part of the noise coding section 205 will be described below in detail.

Figure 7:
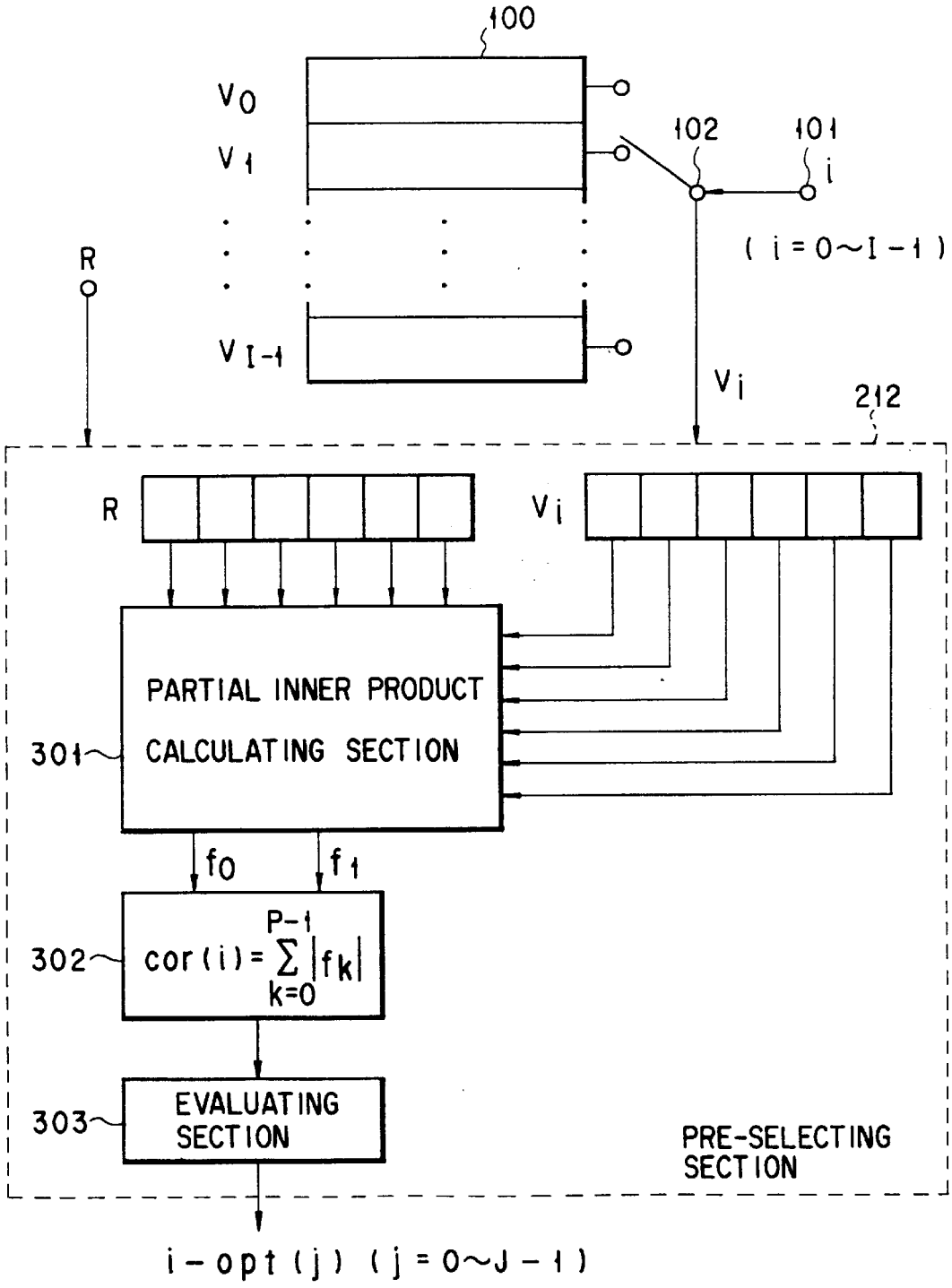
FIG. 7 is a detailed block diagram showing a pre-selecting section in FIG. 6.

FIG. 7 shows the detailed arrangement of the pre-selecting section 212 together with the noise codebook 100. In this case, for descriptive convenience, the number of dimensions of a vector is set to be N=6, and the number of bits of the polarity information index Ip is set to be p=2. Since the polarity is one of +1and −1, it is preferable to divide elements of the vector according to the polarity in order to facilitate the procedure. There is introduced a function indicating the group of elements which has the same polarity. The following description uses an example wherein the above function L is set to be L (p, n)=n mod p (remainder obtained by dividing n by p).

Referring to FIG. 7, a partial inner product calculating section 301 calculates partial inner products $f_k$ (k=0 to p−1) between the seed vector Vi of the index i extracted from the noise codebook 100 and the corrected reference vector R. The partial inner products $f_k$ are obtained by calculating inner products between only elements which satisfy k=n mod p with respect to the positions n=0 to N−1 of the vector elements. Therefore, when p=2, and N=6, the partial inner products $f_k$ are given by the following equations:

$$f_0=r_0v_0+r_2v_2+r_4v_4 \tag{2}$$

$$f_1=r_1v_1+r_3v_3+r_5v_5 \tag{3}$$

In an absolute value adder 302, the sums of the absolute values of the partial inner products $f_k$ are calculated as follows:

$$cor(i)=\sum_{k=0}^{p-1}|f_k| \tag{4}$$

An evaluating section 303 arranges sums cor(i) in order of magnitude, searches for J indexes of the noise codebook which are respectively based on J larger sums cor(i) selected from all the sums cor(i) in order of magnitude, and uses the J indexes as pre-selection outputs.

Each sum cor(i) of the absolute values of partial inner products is equal to the inner product between a vector Ui and the vector R when the polarity vector S is optimally adjusted to the vector Vi. Therefore, the pre-selection of an index for the vector Ui having a corrected shape can be performed by searching for the maximum value of the sums cor(i).

Figure 8:
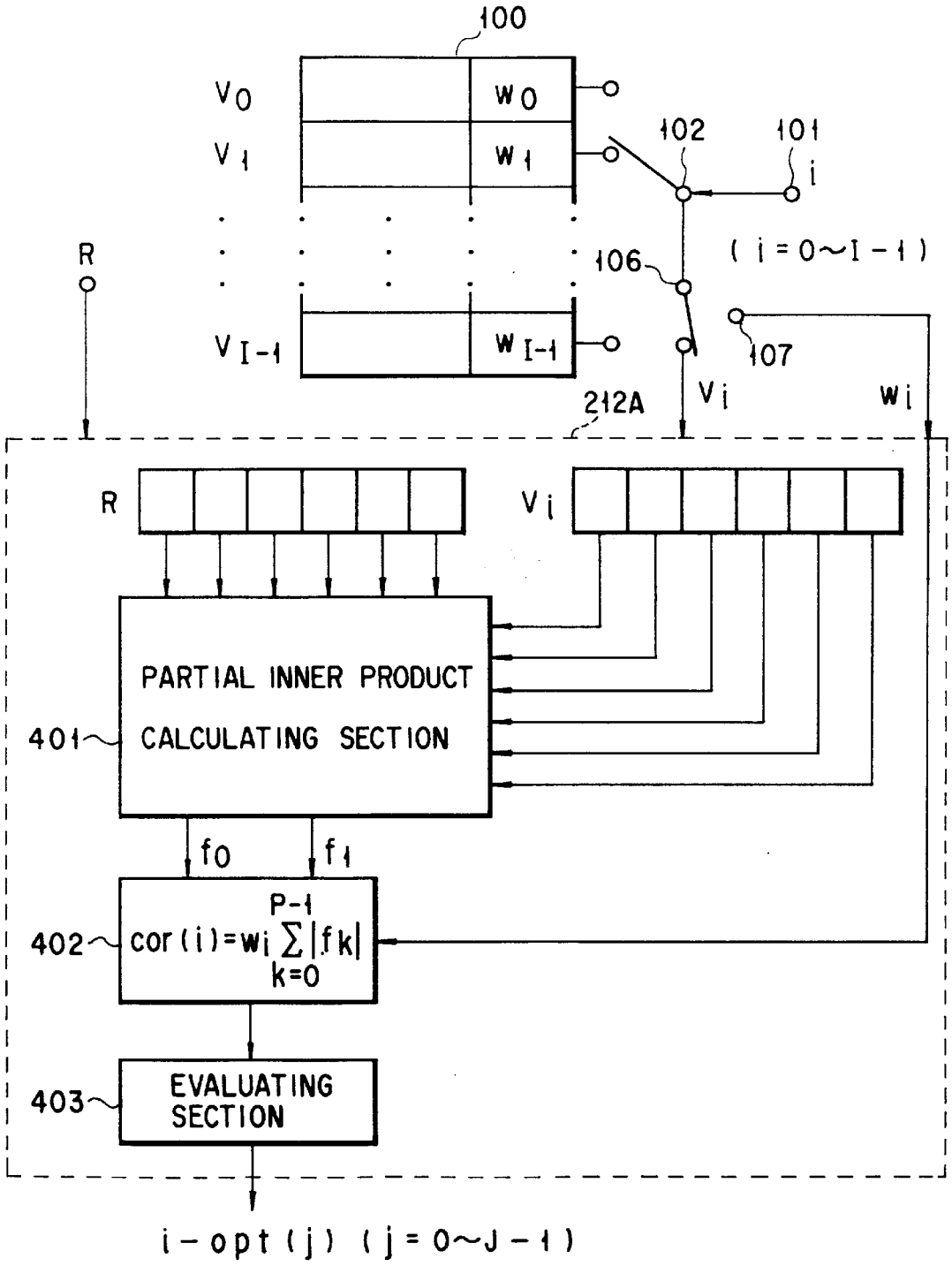
FIG. 8 is a block diagram showing another pre-selecting section.
Figure 9:
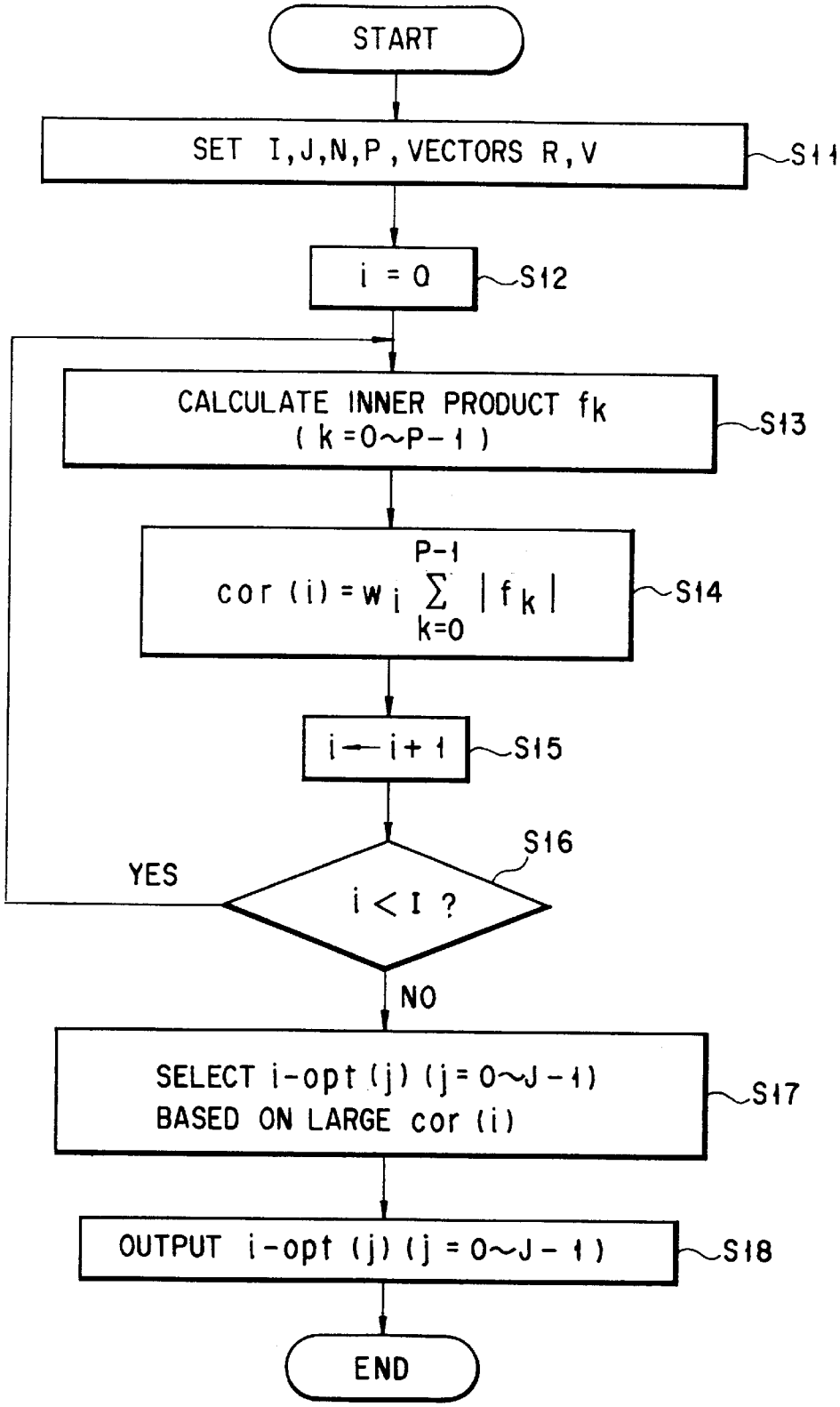
FIG. 9 is a flow chart showing processing of the pre-selecting section shown in FIG. 8.

When the norm of the seed vector Vi stored in the noise codebook 100 is not normalized, an arrangement obtained by correcting the arrangement shown in FIG. 7 into the arrangement shown in FIG. 8 can be used as another arrangement of a pre-selecting section 212A. Referring to FIG. 8, the noise codebook 100 stores a normalized weighting coefficient $w_i$ for each vector besides the seed vectors. In a pre-selecting section 400, a normalized absolute value adder 402 searches for J indexes respectively having J larger sums of normalized absolute values:

$$cor(i)=w_i\sum_{k=0}^{p-1}|f_k| \tag{5}$$

on the basis of the partial inner product $f_k$ and the normalized weighting coefficients $w_i$. The J indexes are used as pre-selection outputs. Note that the inverse number of the norm of the vector Vi can be used as the value of the normalized weighting coefficient $w_i$.

Processing procedures of pre-selection using normalized weighting will be described below.

In step S11, the variables I, J, N, P, the vector R, and the codebook V are set. The codebook is set by setting the address of a memory storing the contents of the codebook so as to use the codebook in a work area.

In step S12, the index of a seed vector is set to be i=0.

In step S13, the partial inner products $f_k$ (k=0 to p−1) between the vector R and the vector Vi are calculated with respect to the index i. In step S14, the sum of the absolute values of the partial inner products $f_k$ is calculated with respect to all k (0 to p−1), and the sum is multiplied by the normalized weighting coefficient $w_i$, thereby calculating the sum cor(i) of normalized absolute values. In step S15, i←i +1 is set. In step S16, it is checked whether i is I or less. If YES in step S16, the processing following step S13 is repeated. In this manner, the processing in step S13 and the processing in step S14 are repeatedly performed until i=0 to I−1 is set.

In step S17, the sums cor(i) of the normalized absolute values are arranged in order of magnitude, J indexes i based on J larger sums of normalized absolute values are selected, and the J indexes i are stored as i-opt(j) (j=0 to J−1).

In step S18, the J selected indexes are output as pre-selection results.

Figure 10:
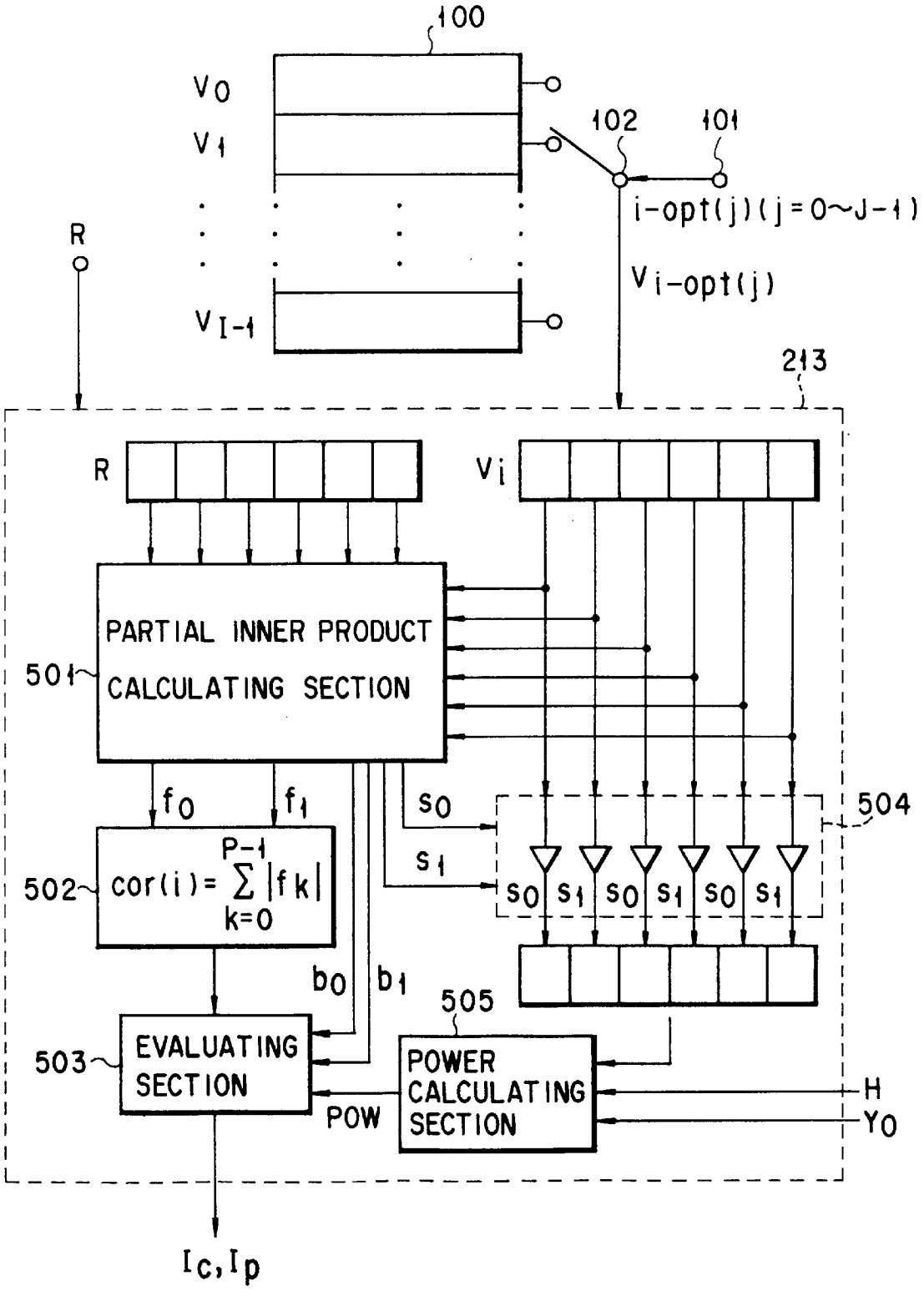
FIG. 10 is a detailed block diagram showing a main selecting section in FIG. 6.

The main selecting section 213 will be described below. FIG. 10 is a block diagram showing an arrangement of the main selecting section 213. The main selecting section 213 comprises a partial inner product calculating section 501, an absolute value adder 502, an evaluating section 503, a polarity multiplier 504, and a normalized power calculating section 505, and is designed to sequentially extract, from the noise codebook 100, the seed vectors V corresponding to the J indexes i-opt(j) (j=0 to J −1) selected by the pre-selecting section 212. In FIG. 10, p=2 and N=6 are set. The partial inner product calculating section 501 calculates not only the partial inner products $f_k$ (k=0 to p−1) between the reference vector R and the seed vectors V corresponding to the indexes extracted from the noise codebook 100, but also a polarity information bit $b_k$ and a polarity $s_k$. The polarity $s_k$ can be defined by the following equation:

$$s_k=\mathrm{sign}(f_k) \tag{6}$$

where sign(x) is a value representing the polarity (positiveness/negativeness) of x.

When the kth bit $b_k$ of the polarity information is set to be, e.g., $b_k=(1-s_k)/2$, the bit $b_k$ can correspond to the polarity $s_k$.

Figure 11:
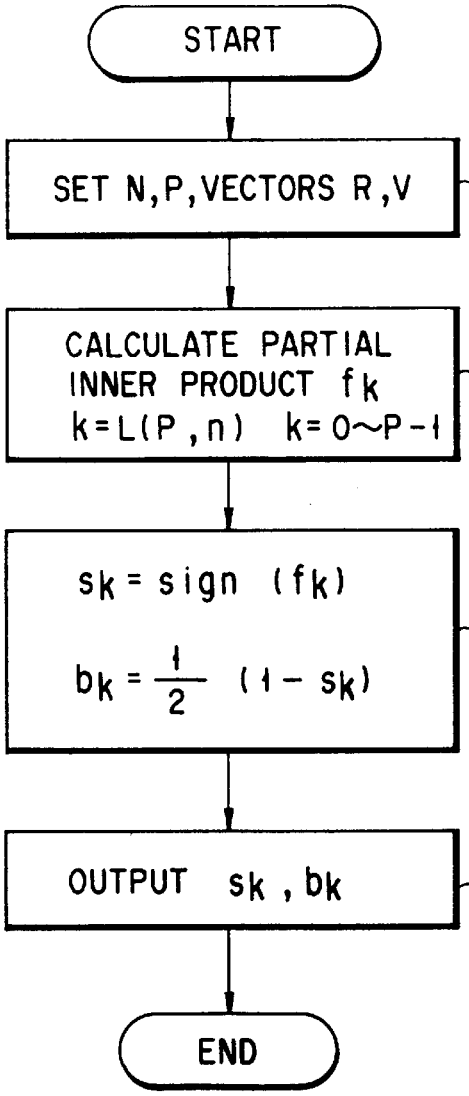
FIG. 11 is a flow chart showing processing procedures of calculating polarity information in the main selecting section shown in FIG. 10.

FIG. 11 shows procedures for calculating the polarity $s_k$ and the polarity information bit $b_k$ on the basis of the reference vector R and the seed vector V.

In step S21, the variables N, P, the vector R, and the seed vector V are set.

In step S22, the partial inner products $f_k$ (k=0 to p−1) are calculated by using the vector R and the vector V.

In step S23, the polarity $s_k$ and the polarity information bit $b_k$ are calculated from the partial inner products $f_k$ to determine the polarity information.

In step S24, the polarity $s_k$ and the polarity information bit $b_k$ are output.

The polarity multiplier 504 uses the polarity $s_k$ calculated with respect to the vector V to generate the vector U each having a shape optimized by the following equation:

$$u_n=v_n\times s_k \ (n=0 \text{ to } N-1,\ k=n \bmod p)$$

For example, when p=2, N=6, and L(p, n)=n mod p $u_0=v_0s_0$, $u_1=v_1s_1$, $u_2=v_2s_0$, $u_3=v_3s_1$, $u_4=v_4s_0$, and $u_5=v_5s^1$, are satisfied.

The power calculating section 505 uses the vector U, a synthesized pitch vector $X_0$, and weighted synthesis filter coefficient information H to calculate a normalized power pow of the synthesis vector of the normalized vector V, and outputs the power pow to the evaluating section 503.

The absolute value adder 502 calculates an inner product value cor(i) by the method described above, and outputs the inner product value cor(i) to the evaluating section 503. The evaluating section 503 selects the optimum index Ic by evaluation processing for each index using the inner product value cor(i) and the power pow. The evaluating section 503 outputs the optimum index Ic together with a polarity information index Ip corresponding to the optimum index Ic.

Figure 12:
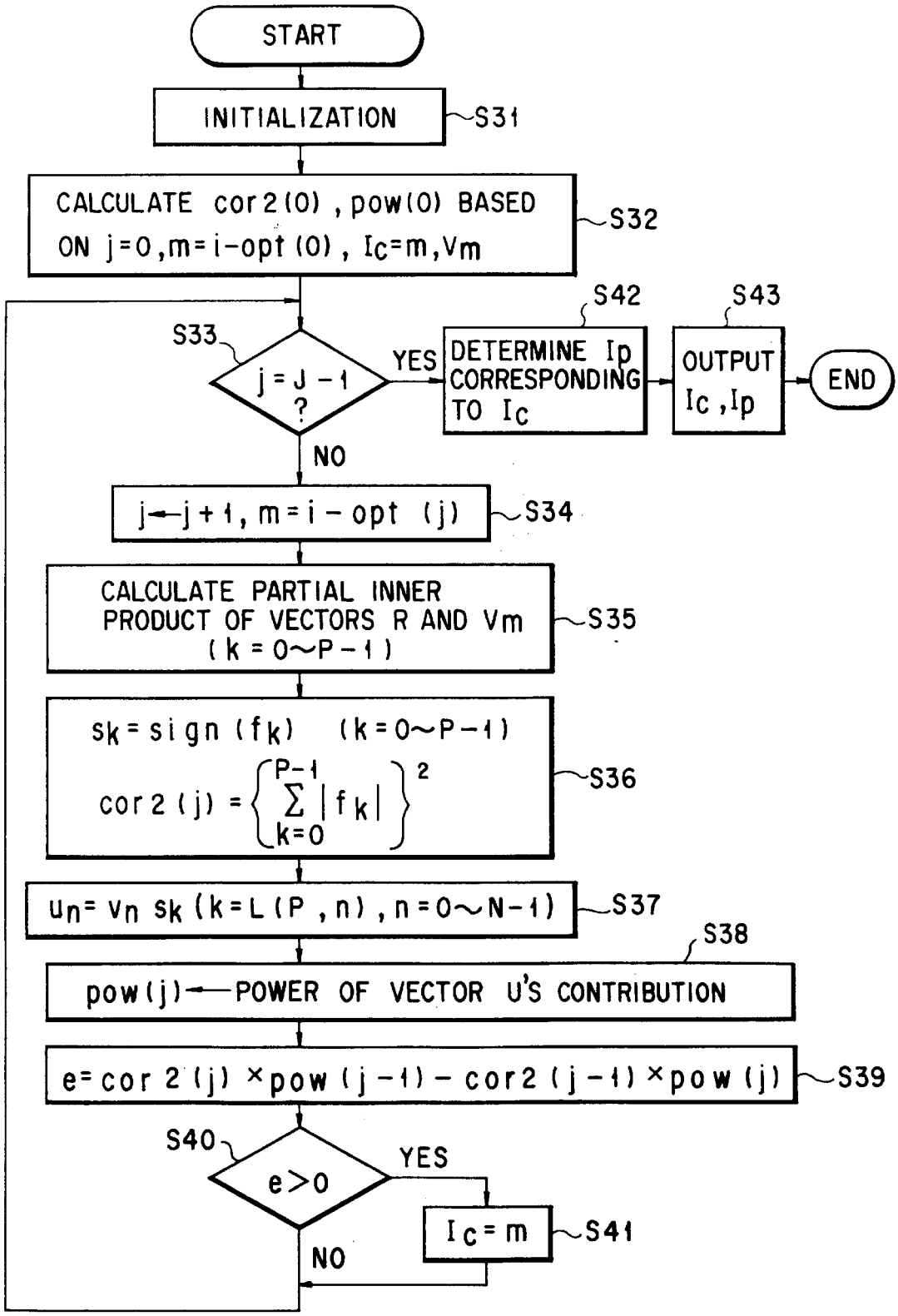
FIG. 12 is a flow chart showing processing procedures of the main selecting section shown in FIG. 10.

FIG. 12 shows the processing procedures of the main selecting section 213.

In step S31, initialization is performed.

In step S32, cor2(0) and pow(0) based on j=0, m=i-opt(0), Ic=m, and Vm are calculated.

In step S33, it is checked whether j=J−1is satisfied. If YES in step S33, Ip corresponding to Ic is determined in step S42, and the indexes Ic and Ip are output in step S43.

If NO in step S33, j←j+1 and m=i-opt(j) are set in step S34, the partial inner product $f_k$ (k=0 to p−1) between the vector R and the vector Vm in step S35. In step S36, the square value of cor(j) corresponding to the index i-opt(j) is calculated and set to cor2(j). In step S37, $u_n=v_n\times s_k$ (k=L(p, n), n=0 to N−1) are calculated. In step S38, a power component to which vector U contributes is set to be pow(j). In step S39, the index i-opt(j) is compared with an index i-opt(j−1) by using cor2(j) and pow as follows:

$$e=cor2(j)\times pow(j-1)-cor2(j-1)\times pow(j) \quad (7)$$

In step S40, it is checked whether e is positive. If YES in step S40, Ic=m is set in step S41. The flow returns to step S33. If NO in step S40, the flow immediately returns to step S33.

In this manner, the index (seed vector index) Ic of the noise codebook and the polarity information index Ip which are obtained from the main selecting section 213 are input to the noise vector reproducing section 215, and multiplication for each element using the vector V corresponding to the index Ic of the noise codebook and extracted from the noise codebook 100 and the vector S corresponding to the polarity information index Ip is performed to calculate the nose code vector (representative code vector) U having an optimum shape.

Figure 13:
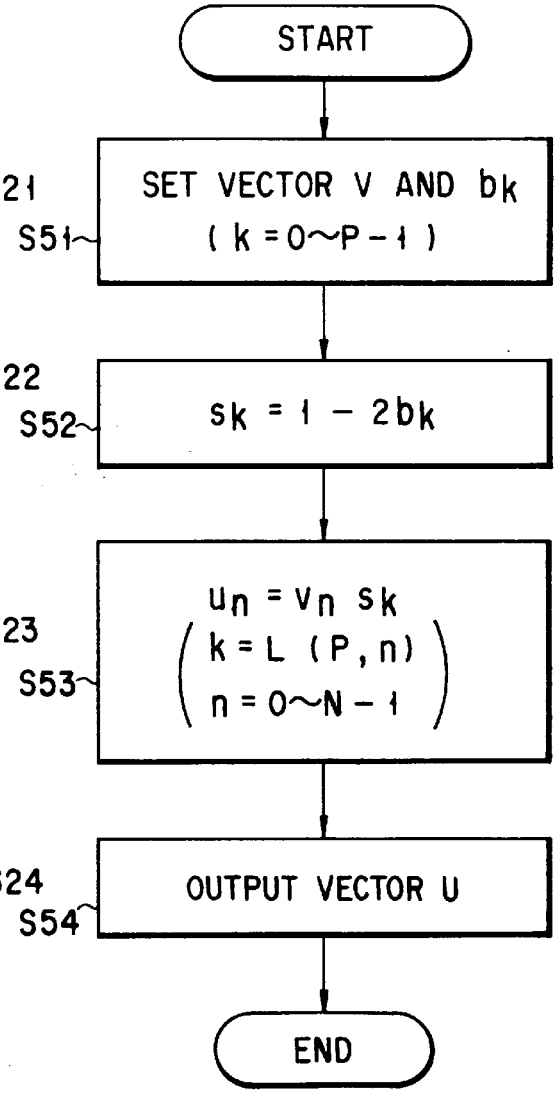
FIG. 13 is a flow chart showing processing procedures of a noise code vector reproducing section according to the third embodiment.

FIG. 13 shows the processing procedures of the noise vector reproducing section 215.

In step S51, the seed vector V corresponding to the index Ic and bits $b_k$ representing the polarity information index Ip are set.

In step S52, the polarity $s_k$ is obtained on the basis of the bits $b_k$.

In step S53, the polarity $s_k$ (k=0 to p−1) is multiplied by each element of the seed vector V to calculate the representative vector U.

In step S54, the vector U is set to be a noise code vector $Y_1$, the noise vector reproducing section 215 calculates a synthesized noise code vector $X_1$ by using weighted synthesis filter coefficient information H and the noise code vector $Y_1$, and outputs the synthesized noise code vector $X_1$.

Returning to the description in FIG. 6, a gain coding section 206 codes gains respectively to be multiplied with a pitch component and a noise component. More specifically, the gain coding section 206 receives the synthesized pitch vector $X_0$ and the synthesized noise code vector $X_1$ which are output from the pitch coding section 204 and the noise coding section 205, and searches an incorporated gain codebook (not shown) for a pair of gains ($g_0$, $g_1$) in which the error between the reference vector X and a vector ($g_0x_0+g_1x_1$) is minimum and an index G corresponding to the pair. The gain coding section 206 outputs the pair ($g_0$, $g_1$) and the index G.

The local decoding section 207 uses the gains $g_0$ and $g_1$, the pitch vector $Y_0$, and the noise code vector $Y_1$ to generate an excitation signal corresponding to a current block (frame). The local decoding section 207 uses the excitation signal and the weighted synthesis filter coefficient information H to generate a local decoded signal.

The multiplexer 208 receives coded parameter information obtained by the coding sections 204, 205, and 206, multiplexes these items of information, and outputs the resultant value to a transmission path or a storage medium.

Figure 14:
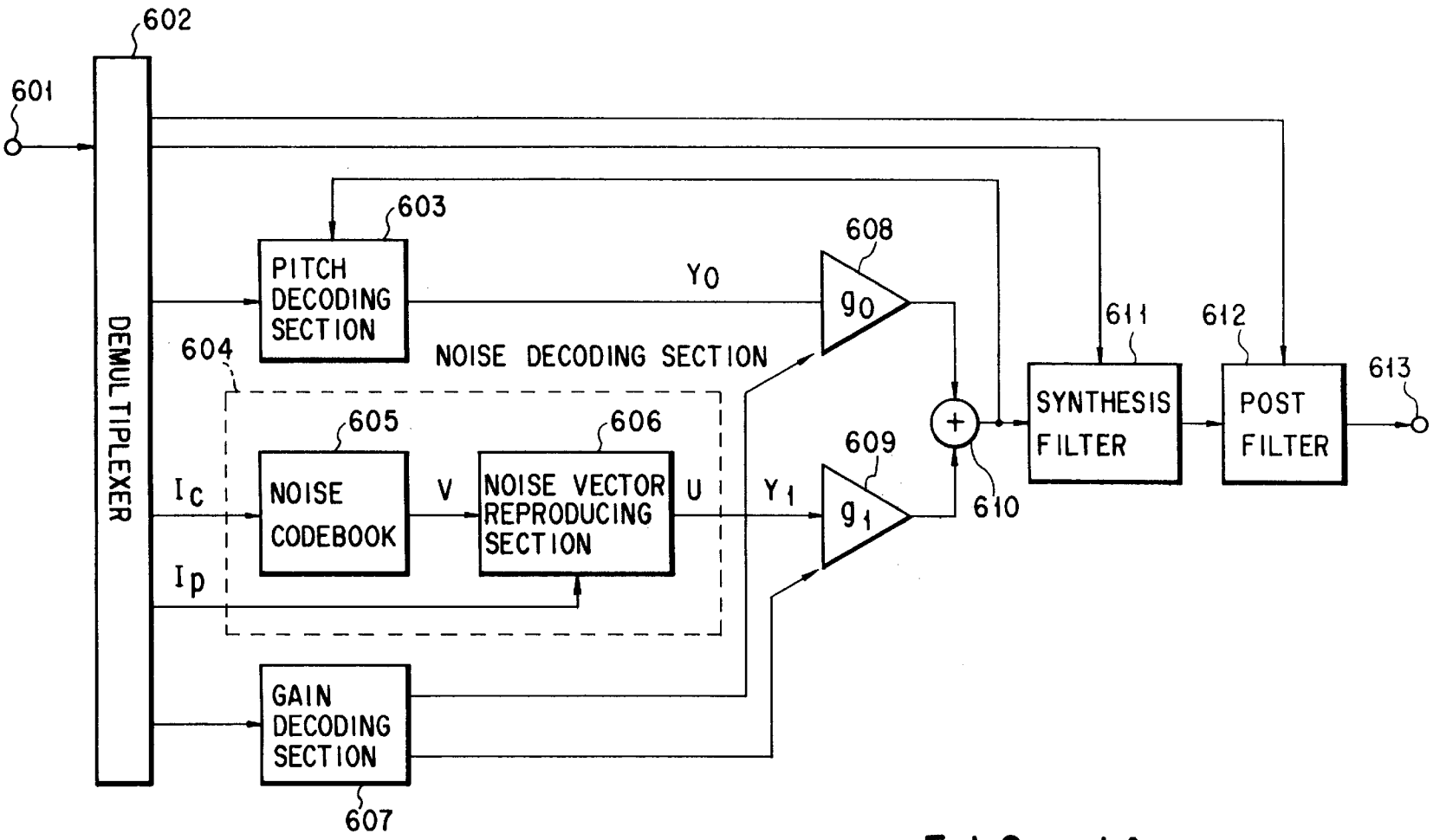
FIG. 14 is a block diagram showing a speech decoding apparatus according to the third embodiment of the present invention.

A speech decoding apparatus for decoding transmission information from the speech coding apparatus to output reproduced speech will be described below with reference to FIG. 14.

Coding parameter information (synthesis filter coefficient information, pitch information, noise index information Ic, polarity information Ip, and gain index information) input from an input terminal 601 is demultiplexed by a demultiplexer 602 into items of information to be used in a decoding sections (to be described later). A pitch decoding section 603 incorporates an adaptive codebook (not shown) storing previous excitation signals as in the speech coding apparatus shown in FIG. 6, and receives indexes to be used for the adaptive codebook from the demultiplexer 602 to reproduce the pitch vector $Y_0$.

A noise decoding section 604 comprises a noise codebook 605 and a noise vector reproducing section 606, uses the vector V corresponding to the coded index Ic of the noise codebook and the polarity information index Ip to reproduce the noise code vector U having a shape which is optimized by the same processing as that performed in the noise vector reproducing section 215 of the speech coding apparatus shown in FIG. 6, and outputs the noise code vector U as the vector $Y_1$. A gain decoding section 607 incorporates a gain codebook (not shown) as in the speech coding apparatus, and reproduces gains $g_0$ and $g_1$ by the decoding index G. Multipliers 608 and 609 and an adder 610 are used to reproduce an excitation signal $g_0y_0+g_1y_1$. A synthesis filter 611 uses decoded synthesis filter coefficient information and the excitation signal to calculate a decoded speech signal, and outputs the decoded speech signal. A post filter 612 is used to perform processing in the final stage of the speech decoding apparatus. The post filter 612 determines filter characteristics on the basis of transmitted coded parameter information, and outputs a decoded speech signal having adjusted quality from a terminal 613 as a reproduced speech signal.

As described above, according to the third embodiment, a polarity information index indicating the polarity of each element $s_n$ of an N-dimensional polarity vector S is generated, and the N-dimensional polarity vector S is generated on the basis of the polarity information indexes. The element $s_n$ of the N-dimensional polarity vector is multiplied by the element $v_n$ of an N-dimensional seed vector V to generate a representative vector U having $v_n \times s_n$ (n=0 to N−1, $|s_n|=1$) as an element, so that the code vector U having a shape changed depending on the polarity information index can be very easily generated with respect to one seed vector V.

In this case, the polarity of the element $s_n$ of the polarity vector S is set to be equal to $s_k$ (k=L(p, n) ($0 \leqq k \leqq p-1$, $1 \leqq p \leqq N$)), the polarity $s_k$ and the kth bit value $b_k$ of the polarity information are caused to correspond to each other to generate a p-bit polarity information index. In this case, the maximum number of shapes of the code vector U which can be generated on the basis of one seed vector V can be limited to $2^p$. Since the bit rate is limited, it is necessary to limit the number of bits of the polarity information index to p-bits. The bit rate can be easily changed by changing the value p.

In addition, when the value p of the function L(p, n) is changed, the number of changeable shapes of the representative vector U can be easily controlled.

In addition, assume that the function L(p ,n) is set as follows:

$$L(p, n)=n \bmod p \tag{8}$$

or $$L(p, n)=\text{floor}(n \times p/N) \tag{9}$$

where floor(x) is the maximum integer which does not exceed x.

In this case, the number of elements $u_n$ of the code vector U generated by using the same polarity can be made uniform. In general, when the above function L(p,n) is used, the information of each bit $b_k$ representing polarity information can effectively reflect a change in shape of the code vector U.

The polarity vector S capable of generating the code vector U in which the shape error between the vector U and the target vector R is minimum is determined as follows. That is, the partial inner product $f_k$ between the target vector R and the vector V is calculated with respect to the nth vector element which satisfies k=L(p, n), and $s_k$=sign($f_k$) (sign(x) is a positive/negative polarity value of x). In this manner, independent of the number p of bits of the polarity information index, $s_k$ and $b_k$ (k=0 to p−1) can be determined by calculations in which the number of dimensions of the vector is small. Therefore, even if the number p of bits of the polarity information index is set to be 10 or more, a calculation amount required for searching for the optimum p-bit polarity information $\{b_0, b_1, \ldots, b_{p-1}\}$ (corresponding to an index in normal vector quantization) does not increase. Therefore, it is understood that the vector quantization apparatus of this embodiment is particularly suitable for a coding apparatus in which a calculation amount for real-time processing is strictly limited.

In addition, a plurality of seed vectors V are present in this embodiment. That is, it is an effective method that the arrangement of seed vectors can be expanded into the arrangement represented by Vi (i=0 to I−1). More specifically, the code vector U is expressed by two items of information, i.e., the seed vector index Ic for selecting one optimum seed vector V from vectors Vi and the optimum polarity information index Ip corresponding to the seed vector index Ic. In this case, when the following means are used in the process of selecting a seed vector index, a calculation $amou_n$ t required for index search can be considerably reduced. That is, in order to select a small number J of indexes from a large number I of seed vector indexes, by using the equation $$cor(i) = \sum_{k=0}^{p-1} |f_k|$$

which calculated on the basis of the partial inner product $f_k$ between the target vector and the code vector with respect to the nth vector element which satisfies that k of the seed vector Vi is equal to L(p, n) (k and p are integers which satisfy 0 . . . k . . . p−1and 1 . . . p . . . N), the number of seed vector indexes is decreased to J (0<J<<I). This is because cor(i) is the inner product between the optimum representative vector Ui obtained from the seed vector Vi and the target vector R.

In the vector quantization apparatus according to this embodiment, even if the number p of bits of the index used for vector quantization is set to be a very large value, i.e., 10 or more, the index search requires a very small processing amount. Therefore, the vector quantization apparatus is suitable for real-time processing.

According to this embodiment, even if the number I of seed vectors Vi is set to be considerably smaller than that of the conventional method, a larger number of code vectors can be realized in the form of a codebook, and a memory capacity required to store seed vectors can be saved.

In addition, according to this embodiment, even if polarity information is degraded due to a code error on a transmission path or a storage medium, a code vector having small degradation can be advantageously reproduced. This is because 1-bit polarity information influences the polarity of a portion of the code vector. As a result, the error of the 1-bit polarity information does not degrades the whole shape of the code vector, but partially degrades the shape of the code vector. Therefore, the vector quantization apparatus according to this embodiment advantageously has high resistance to the code error of polarity information.

FORTH EMBODIMENT

Figure 15:
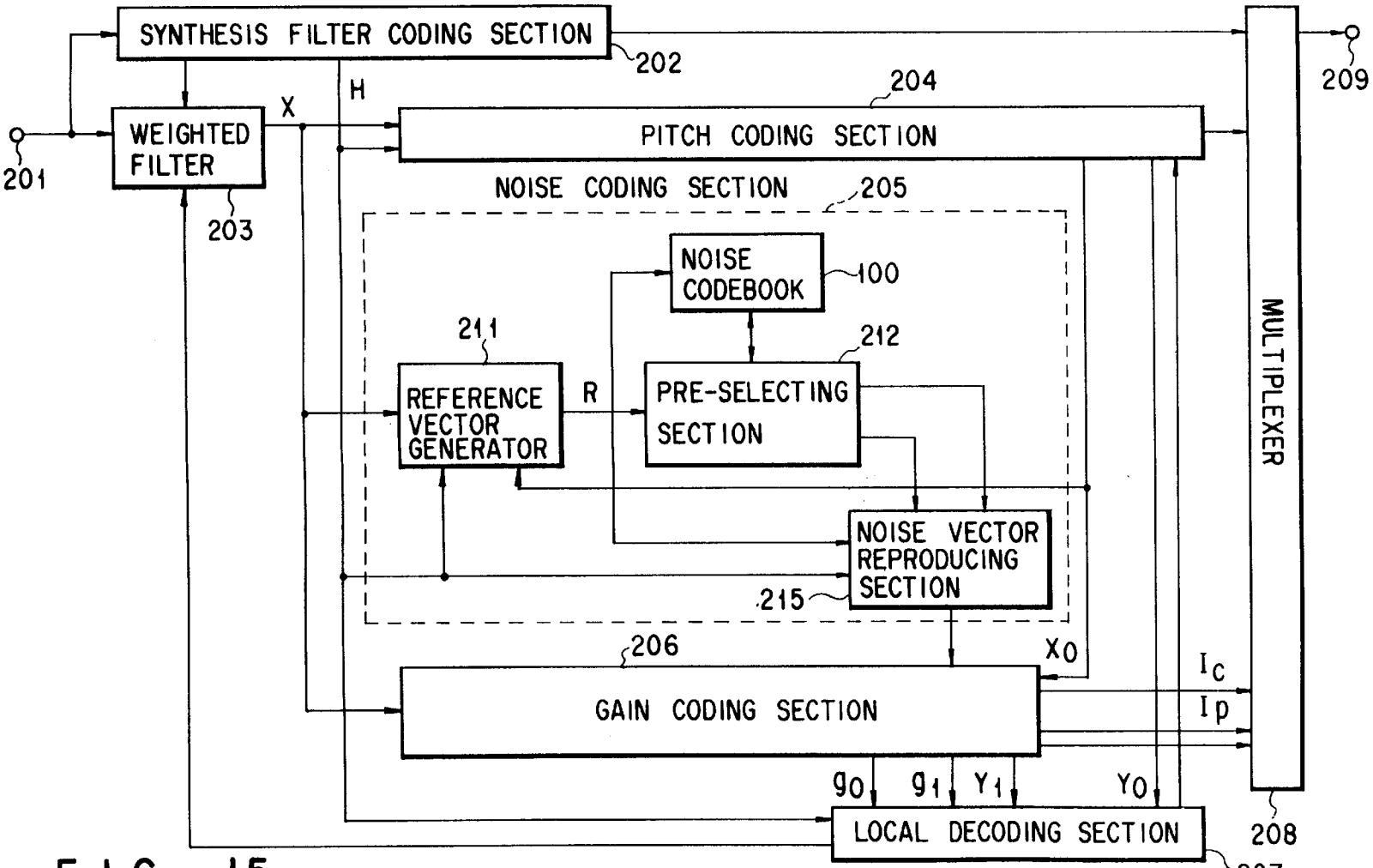
FIG. 15 is a block diagram showing a speech coding apparatus according to the fourth embodiment of the present invention.

FIG. 15 is a block diagram showing a speech coding apparatus according to the fourth embodiment. This embodiment is different from the third embodiment in that a noise coding section 205 selects a small number of pairs of indexes of a noise codebook 100 and a polarity information index, and a gain coding section 206 finally selects one pair of indexes Ic and Ip from the small number of pairs of indexes.

Referring to FIG. 15, a noise coding section 205 comprises a corrected reference vector generator 211, the noise codebook 100, a pre-selecting section 212, and a noise vector reproducing section 215. The pre-selecting section 212 uses a corrected reference vector R and the noise codebook 100 to select a small number (J) of indexes from a larger number of indexes in the codebook 100. The J indexes and polarity information indexes corresponding to the J indexes are supplied to the noise vector reproducing section 215. The noise vector reproducing section 215 has the same function as that of the noise vector reproducing section 215 of the first embodiment. The noise vector reproducing section 215 outputs J pairs of indexes of the codebook and the polarity information indexes corresponding thereto to a gain coding section 206. The gain coding section 206 codes gains for the J pairs input thereto by using synthesized pitch vectors $X_0$ by the same method as that used in the gain coding section 206 of the first embodiment. Finally, a pair of vectors having the minimum error with respect to a reference vector X is selected from the J pairs. In this case, when the noise code vector is represented by $Y_1$, the index of the codebook, Ic, and the polarity information index, Ip, gains $g_0$ and $g_1$ are output to a local decoding section 207, and the indexes Ic and Ip and an index G of the gain codebook 100 are output to a multiplexer 208.

The other arrangements of the fourth embodiment are the same as those of the third embodiment, and a description thereof will be omitted.

FIFTH EMBODIMENT

In the speech coding/decoding apparatuses described above, it is an important problem determining how to reduce the information amount of a code transmitted from the coding apparatus. In particular, an excitation signal for a synthesis filter is called a signal obtained by modeling a signal generated by human vocal chords, and has a characteristic feature in which the power of the excitation signal moderately changes with time. Therefore, various methods of using this characteristic feature to reduce the number of bits required for quantization in transmission of the index information of a gain codebook are provided. Several embodiments in which, in transmission of the information of a gain by which the code vector is multiplied, quantization is performed to reduce the number of bits required for quantization of the index information of the gain codebook will be described below.

Figure 16:
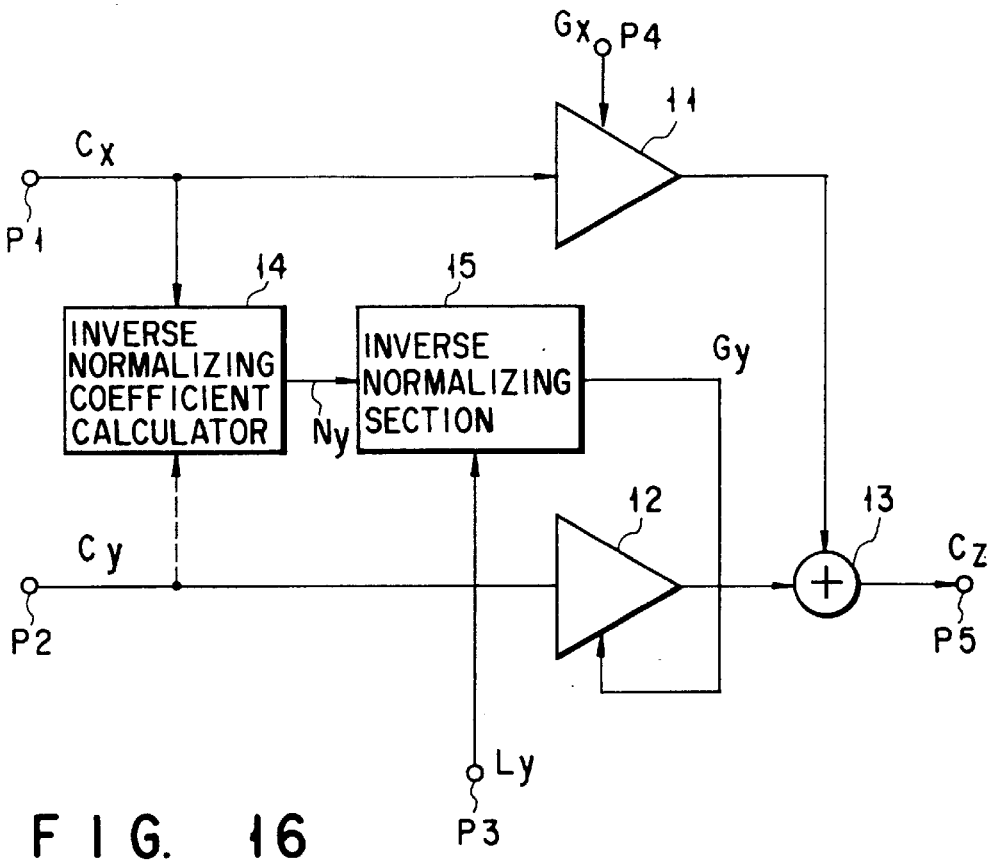
FIG. 16 is a block diagram showing a gain quantization apparatus according to the fifth embodiment of the present invention.

FIG. 16 shows the arrangement of a gain quantization apparatus according to this embodiment. Code vectors Cx and Cy respectively input to terminals P1 and P2 are multiplied by gains Gx and Gy by means of gain circuits 11 and 12, respectively, and the resultant vectors are synthesized with each other by an adder 13 to be an output vector Cz. The output vector Cz is output from a terminal P5. The gain Gx is supplied from a terminal P4, and the gain Gy is supplied from an inverse normalizing section 15.

The input vectors Cx and Cy are input to an inverse normalizing coefficient calculator 14, and an inverse normalizing coefficient Ny is calculated by the inverse normalizing coefficient calculator 14. The gain Gy of the gain circuit 12 is obtained such that a normalized gain Ly supplied to the normalizing section 15 is inversely normalized by using the inverse normalizing coefficient Ny. The gain Gx of the gain circuit 11 and the normalized gain Ly of the gain circuit 12 are quantized as needed, and then transmitted to a transmission path or stored in a storage medium.

In this case the inverse normalizing coefficient Ny is expressed as follows:

$$Ny = \sqrt{Py/Px} \tag{10}$$

where Px and Py are powers of the input vectors Cx and Cy, respectively.

Note that, when the value of the power Px is set to be a constant value in advance or is designed to be a constant value, the inverse normalizing coefficient Ny can also calculated as follows:

$$Ny = \sqrt{Px} \tag{11}$$

The gain Gy can be calculated by using the inverse normalizing coefficient Ny as follows:

$$Gy = Ly/Ny \tag{12}$$

The gain quantization apparatus of this embodiment operates especially effectively in the following case. That is, as described in a speech coding apparatus to be described later according to this embodiment, the power of the input vector Cx is almost equal to that of the output vector Cz, and the input vector Cy has a power which is not adjusted like a code vector obtained from the noise codebook. In this case, although the gain Gx of the gain circuit 11 has a value close to 1.0, the gain Gy supplied to the gain circuit 12 has a value changing depending on the magnitude of the output vector Cz.

In this case, according to this embodiment, even if the value of the output vector Cz changes, as is apparent from expression (12), the value of the normalized gain Ly does not change. Therefore, the number of quantization bits required to transmit/store the information of the normalized gain Ly is smaller than that in a case where the information of the gain Gy is directly transmitted and stored.

This mechanism will be described below with reference to a simple example. For example, assume that the power of the output vector Cz becomes four times grater. As described above, since the power Px of the input vector Cx is almost equal to the power of the output vector Cz, the power Px of the input vector Cx becomes four times grater. As described above, the power of the input vector Cy is not adjusted. As a result, the value of the gain Gy supplied to the gain circuit 12 becomes twice in amplitude. However, the normalized gain Ly is given by the following expression:

$$\begin{aligned} Ly &= Gy \times Ny \\ &= 2.0 \times Gy \times \sqrt{4.0 \times Py/Px} \\ &= Gy \times \sqrt{Py/Px} \end{aligned} \tag{13}$$

Even if the normalized gain Ly is not changed, the gain Gy of the gain circuit 12 can be changed.

When normalization is not performed, the gain Gy changes depending on a change in the output vector Cz. Therefore, transmission of the information of the gain Gy requires a large number of bits. In contrast to this, according to this embodiment, the normalized gain Ly does not change depending on the change in the output vector Cz. Therefore, transmission/storage can be performed with a small number of bits. This embodiment is used on the coding side of the speech coding/decoding apparatuses.

SIXTH EMBODIMENT

An embodiment of a speech coding apparatus using the gain quantization apparatus shown in FIG. 16 will be described below with reference to FIG. 17. As in the above embodiments, this speech coding apparatus is based on a CELP scheme. The speech coding apparatus comprises a gain quantization section 10 having the same arrangement as that of the gain quantization apparatus shown in FIG. 16, a gain code book 30, an adaptive codebook 31, a noise codebook 32, a normalized gain codebook 33, an LPC analysis section 35, a weighted synthesis filter 36, a perceptional weighting section 37, an error calculator 38, and an error evaluating section 39. The error evaluating section 39 has the functions of the index selecting sections 2320 and 2325 in FIG. 1, or the functions of coding sections 202, 204, 205, and 206 and the function of the multiplexer 208 in FIG. 6.

The operation of the speech coding apparatus is as follows.

A speech signal to be coded is input to an input terminal 34. This input speech signal is analyzed by the LPC analysis section 35 to calculate the filter coefficient of the weighted synthesis filter 36. The input speech signal is also input to the perceptional weighting section 37, thereby obtaining a weighted input speech signal. The influence of a previous frame is removed from the weighted input speech signal, thereby obtaining a target signal.

The adaptive codebook 31 is a codebook which is based on previous excitation signals for exciting the weighted synthesis filter 36 and changes with time. The weighted synthesis filter 36 also generates a code vector (hereinafter an adaptive code vector) based on a pitch. On the other hand, the noise codebook 32 is a normal fixed codebook which stores noise component code vectors (hereinafter noise code vectors). An adaptive code vector obtained from the adaptive codebook 31 and a noise code vector obtained from the noise codebook 32 are respectively input to terminals P1 and P2 of the gain quantization section 10 described in FIG. 16 as the input vectors Cx and Cy, respectively.

In the gain quantization section 10, a gain circuit 11 multiplies the adaptive code vector Cx input to the terminal P1 by a predetermined gain Gx input from a terminal P4 and expressed by the gain code vector from the gain codebook 30, and a gain circuit 12 multiplies the noise code vector input to the terminal P2 by a gain Gy output from an inverse normalizing section 15. An output vector obtained by causing an adder 13 to add outputs from the gain circuits 11 and 12 to each other is output from a terminal P5 as an excitation signal for exciting the weighted synthesis filter 36. This excitation signal is also input to (stored in) the adaptive codebook 31 to prepare the next frame processing.

The error between the synthesis speech signal obtained by the weighted synthesis filter 36 and the target signal is evaluated by the error evaluating section 39, the search of the adaptive codebook 31, the noise codebook 32, and the normalized gain codebook 33 for a combination of an adaptive code vector, a noise code vector, and a gain is performed such that the error is minimum. The error calculated by the error calculator 38 is evaluated by the error evaluating section 39. When the error is minimum, an index F representing the filter coefficient of the weighted synthesis filter 36, an index I representing the adaptive code vector from the adaptive codebook 31, an index J representing the noise code vector from the noise codebook 32, an index K representing a normalized gain Ly which is obtained by normalizing the gain Gy of the gain circuit 12 from the normalized gain codebook 33, and an index L representing the gain Gx of the gain circuit 11 from the gain codebook 30 are output to a transmission path or a storage medium (not shown) as coding parameters.

This embodiment has a characteristic feature in which the gain Gy of the noise code vector can be obtained by the normalized gain code Ly obtained from the normalized gain codebook 33 and a normalizing coefficient Ny obtained by an inverse normalizing coefficient calculator 14. That is, attention is given to the point that most of the power of the excitation signal input to the weighted synthesis filter 36 is occupied by the power of the adaptive code vector from the adaptive codebook 31. The gain quantization section 10 according to this embodiment uses this point. This tendency is especially conspicuous in a voice period which changes sound quality, and the embodiment has excellent performance especially in the voice period.

Note that, as a prior art, a method of normalizing a gain on the basis of the power of the excitation signal used in a frame prior to a current frame to be coded is known. When it is considered that the adaptive codebook 31 is formed by the excitation signal of the previous frame, the arrangement of this embodiment seems to be similar to that of the prior art. Since the embodiment may be erroneously recognized as the prior art, the differences between the embodiment and the prior art will be described below.

Figure 18:
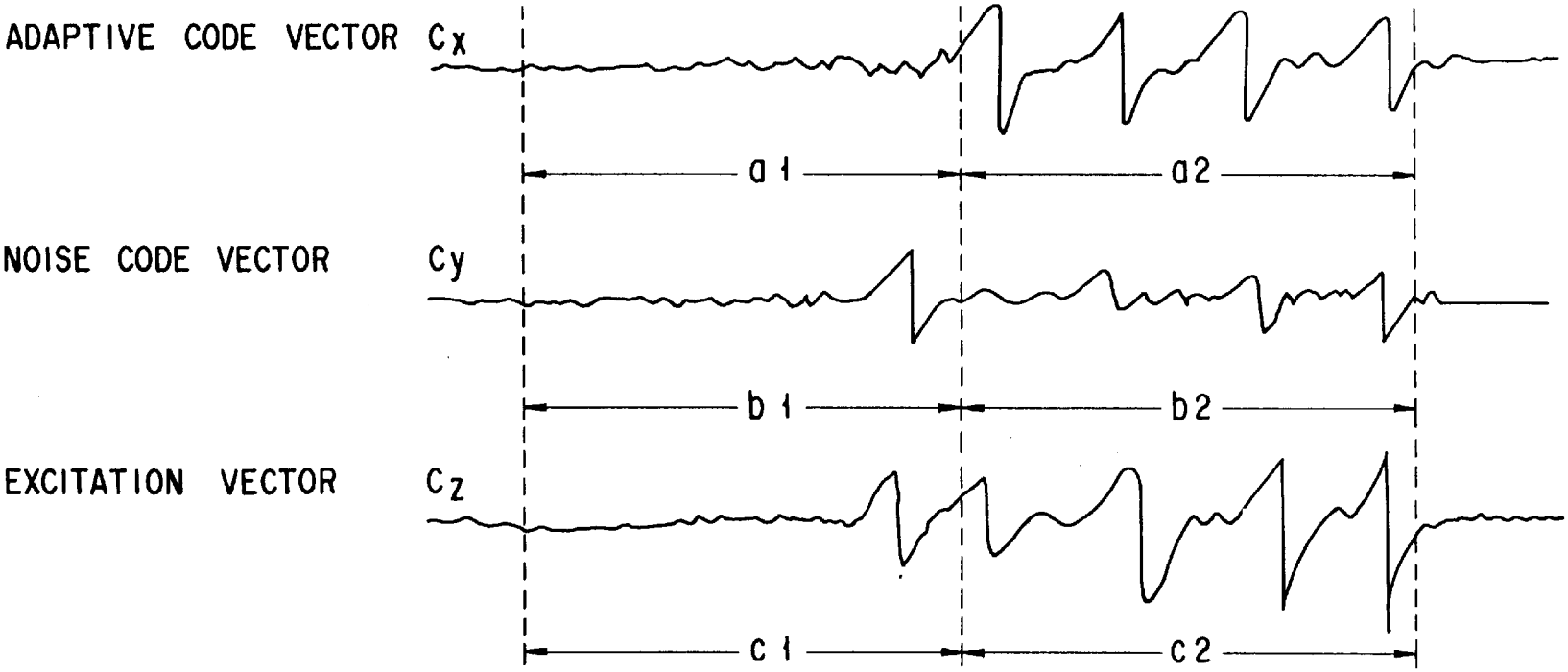
FIG. 18 is a waveform chart showing an adaptive code vector, a noise code vector, and an excitation signal illustrating the operation of the sixth embodiment.

FIG. 18 shows the 2-frame waveforms of the adaptive code vector Cx from the adaptive codebook 31, the noise code vector Cy from the noise codebook 32, and an excitation signal (excitation vector) Cz output from the adder 13 at the leading edge of input speech.

A case where the second-half frame shown on the right side in FIG. 18 is processed will be considered. If a vocal sound does not change, i.e., if the characteristics of the weighted synthesis filter 36 do not change, the magnitude of speech is determined by the power of the excitation signal Cz input to the weighted synthesis filter 36. Therefore, the excitation signal Cz to be used in normalization of the gain in the second-half frame may be suitable for the excitation signal Cz in a period c2 of FIG. 18. However, since the excitation signal Cz in the period c2 is obtained after the gain is determined, the excitation signal Cz cannot be used for normalization of the gain. Therefore, in the prior art described above, the gain has been normalized by using the power of the excitation signal of the previous frame, i.e., the excitation signal Cz in a period cl on the basis of the character that the power of the excitation signal moderately changes. However, as apparent from FIG. 18, since the difference between the excitation signals Cz in the periods c1 and c2 is large at the leading edge of speech or the like, it poses a problem in efficiency that the excitation signal in the period c1 is used in normalization of the gain.

In contrast to this, according to this embodiment, an inverse normalizing coefficient is calculated by using the power of the adaptive code vector Cx in a period a2 of the current frame, and the gain is inversely normalized by the inverse normalizing coefficient. The adaptive code vector of the period c2 has a waveform generated by repeating a pitch waveform from the excitation signal of the previous frame. This waveform is not the same as that of the excitation signal of the previous frame, and is similar to the waveform of the excitation signal of the current frame. Therefore, since the power of the adaptive code vector in the period a2 is close to the power of the excitation signal in the period c2, an inverse normalizing coefficient is calculated by using the adaptive code vector to inverse normalize the gain. Therefore, inverse normalization can be more efficiently performed.

As described above, according to the sixth embodiment, an inverse normalizing coefficient is calculated by using the first input vector Cx obtained by the current frame. On the basis of the inverse normalizing coefficient, the gain of the second input vector Cy is calculated from a normalized gain. In this case, since the normalized gain does not change depending on a change in the output vector by which the gain is multiplied, the information of the normalized gain can be transmitted or stored with a small number of bits. In addition, when the input vector of the current frame is close to the output vector, the inverse normalizing coefficient is calculated by using the input vector of the current frame.

Therefore, inverse normalization efficiency is improved in the transition portion of an input signal, and the performance of gain quantization is improved.

Therefore, in the speech coding apparatus according to this embodiment, when a gain by which the noise code vector is multiplied is quantized in an apparatus for generating an excitation vector obtained by combining the adaptive code vector and the noise code vector to each other as the excitation signal of the synthesis filter, an inverse normalizing coefficient is calculated by using the adaptive code vector serving as a code vector which preferably reflects the characteristics of the current frame. The inversely normalized gain of the noise code vector is calculated by using the inverse normalizing coefficient.

SEVENTH EMBODIMENT

Figure 19:
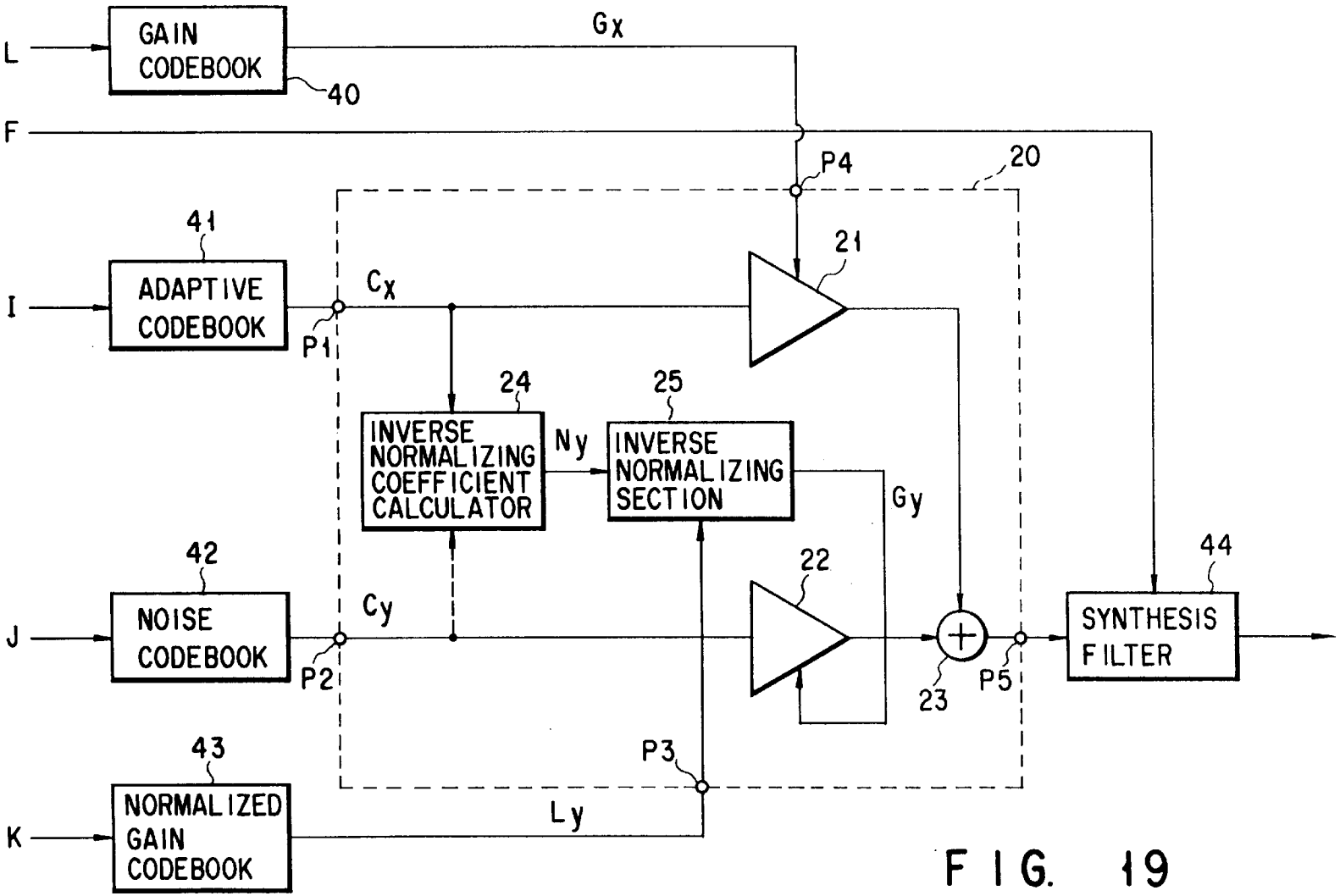
FIG. 19 is a block diagram showing a speech decoding apparatus according to the seventh embodiment of the present invention.

An embodiment of a speech decoding apparatus using the gain quantization apparatus in FIG. 16 will be described below with reference to FIG. 19. This speech coding apparatus decodes an original speech signal on the basis of coding parameters input from the speech coding apparatus shown in FIG. 17 through a transmission path or a storage medium. Indexes F, I, J, K, and L serving as the coding parameters are input to a synthesis filter 44, an adaptive codebook 41, a noise codebook 42, a normalized gain codebook 43, and a gain codebook 40, respectively.

Figure 17:
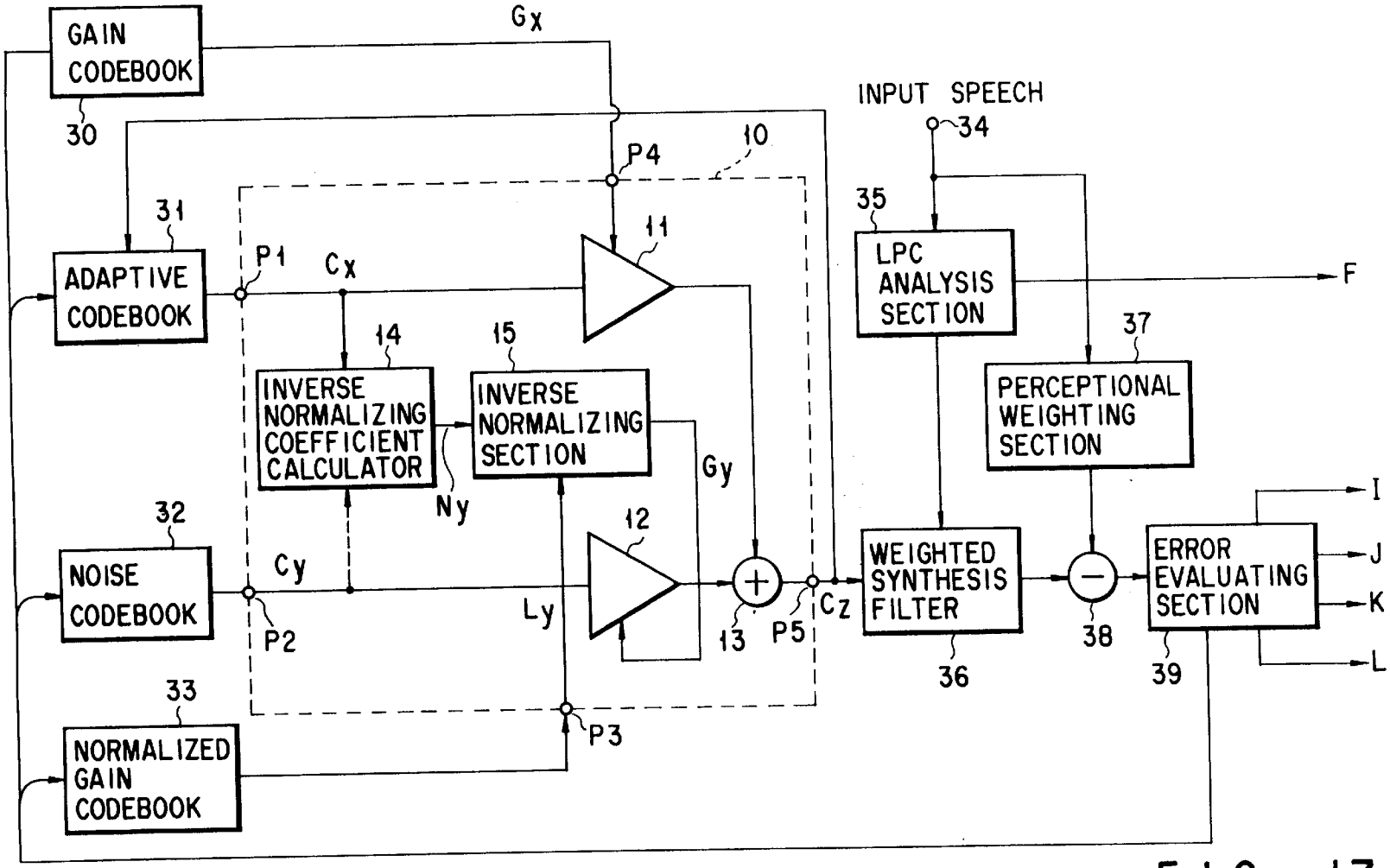
FIG. 17 is a block diagram showing a speech coding apparatus according to the sixth embodiment of the present invention.

The adaptive code vector and noise code vector which are the same as those output from the adaptive codebook 31 and the noise codebook 32 on the basis of the indexes I and J in the speech coding apparatus in FIG. 17 are obtained from the adaptive codebook 41 and the noise codebook 42. The adaptive code vector and noise code vector are respectively input, as input vectors Cx and Cy, to terminals P1 and P2 of a gain quantization section 20 having the same arrangement as that of the gain quantization apparatus described in FIG. 16.

In the gain quantization section 20, a gain circuit 21 multiplies the adaptive code vector input to the terminal P1 by a gain Gx obtained from the gain codebook 40, and a gain circuit 22 multiplies the noise code vector input to the terminal P2 by a gain Gy obtained by performing inverse normalizing calculation to the normalized gain Ly by using an inverse normalizing coefficient Ny in an inverse normalizing section 25. An output vector obtained by causing an adder 23 to add outputs from the gain circuits 21 and 22 to each other is used as an excitation signal for exciting the synthesis filter 44. On the basis of the index F, the filter coefficient of the synthesis filter 44 is set to have the same characteristics as those of the filter coefficient of the synthesis filter 36 in the speech coding apparatus shown in FIG. 17. As a result, the original speech signal is obtained from the synthesis filter 44 as a decoded output.

As described above, in the speech decoding apparatus according to this embodiment, an apparatus for decoding original speech on the basis of coding parameters input from the speech coding apparatus of the fifth embodiment through a transmission path or a recording medium uses the adaptive code vector serving as a code vector which preferably reflects the character of the speech of a current frame to calculate an inverse normalizing coefficient, and the normalized gain in the coding parameters is inversely normalized by using the inverse normalizing coefficient to obtain a gain by which the noise code vector is to be multiplied.

EIGHTH EMBODIMENT

Figure 20:
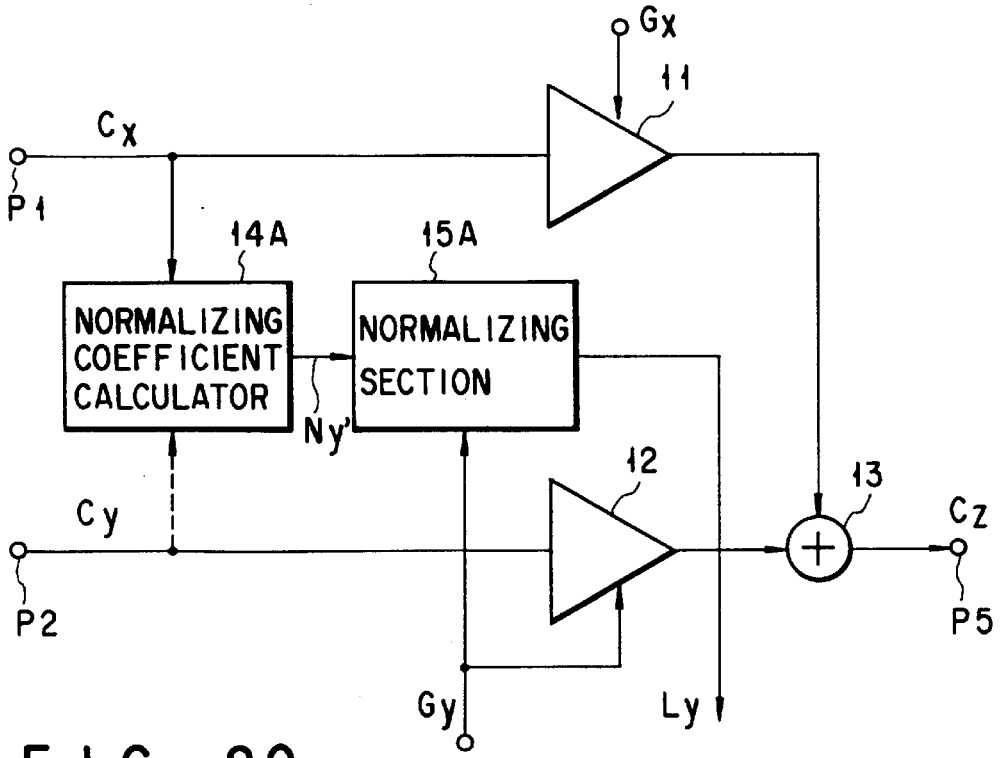
FIG. 20 is a block diagram showing a gain quantization apparatus according to the eighth embodiment of the present invention.

FIG. 20 shows the arrangement of a gain quantization apparatus according to the eighth embodiment related to a modification of the fifth embodiment. Code vectors Cx and Cy input to terminals P1 and P2 are multiplied by gains Gx and Gy by means of gain circuits 11 and 12, respectively, and the resultant vectors are synthesized with each other by an adder 13 to be an output vector Cz. The output vector Cz is output from a terminal P5.

The input vectors Cx and Cy are input to a normalizing coefficient calculator 14A, and the normalizing coefficient calculator 14A calculates a normalizing coefficient Ny'. A normalized gain Ly obtained by causing a normalizing section 15A to normalize the gain Gy of the gain circuit 12 is quantized as needed, and the resultant value is transmitted to a transmission path for storage in a storage medium.

In this case, the normalizing coefficient Ny' is expressed as follows:

$$Ny' = \sqrt{Py/Px} \tag{14}$$

Note that, when the value of a power Px is set to be a constant value or designed to be an almost constant value, the normalizing coefficient Ny' can also be calculated as follows:

$$Ny' = \sqrt{Px} \tag{15}$$

The normalized gain Ly can be calculated by using the normalizing coefficient Ny' as follows:

$$Ly = Gy \times Ny' \tag{16}$$

In the gain quantization apparatus according to this embodiment, a normalizing coefficient is calculated by using the first input vector obtained in the current frame, once a normalized gain obtained by normalizing the value of the gain of the second input vector is calculated on the basis of the normalizing coefficient. Since the normalized gain calculated as described above does not change depending on a change in vector output after multiplication of the gain, the information of the normalized gain can be transmitted or stored with a small number of bits. In addition, when the input vector of the current frame is close to the output vector, the normalizing coefficient is calculated by using the input vector of the current frame. Therefore, normalizing efficiency is improved in the transition portion of an input signal, and the performance of gain quantization is improved.

NINTH EMBODIMENT

Figure 21:
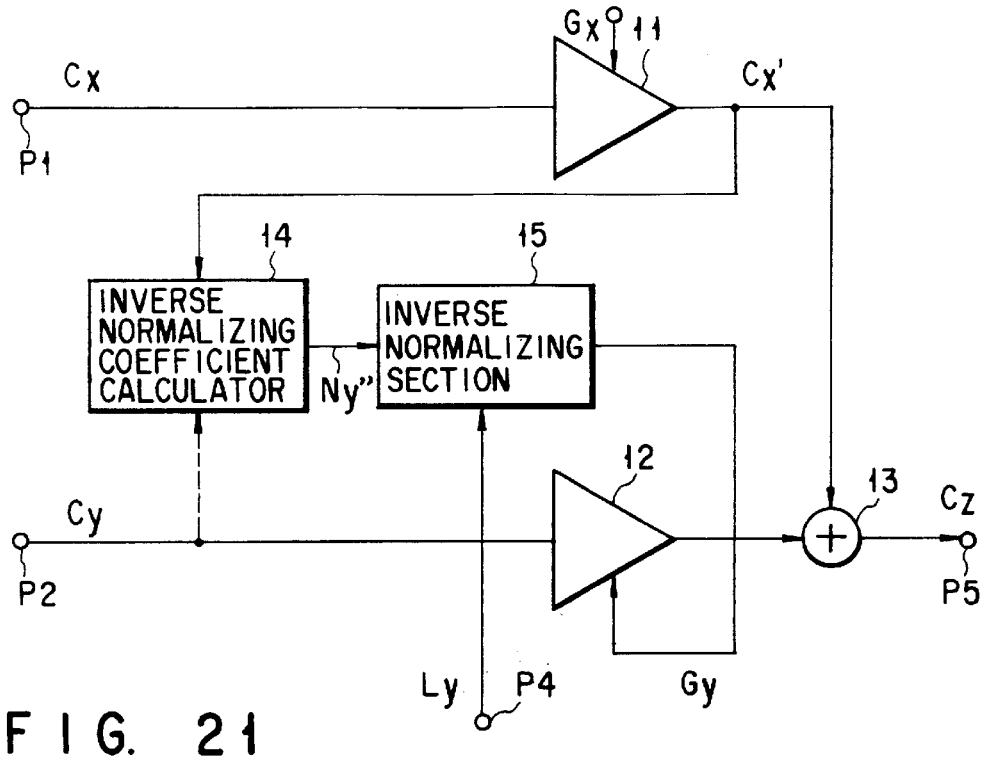
FIG. 21 is a block diagram showing a gain quantization apparatus according to the ninth embodiment of the present invention.

FIG. 21 shows the arrangement of a gain quantization apparatus according to the ninth embodiment related to a modification of the fifth embodiment. Code vectors Cx and Cy input to terminals P1 and P2 are multiplied by gains Gx and Gy by means of gain circuits 11 and 12, respectively, and the resultant vectors are synthesized with each other by an adder 13 to be an output vector Cz. The output vector Cz is output from a terminal P5. An output vector Cx' (a vector obtained by causing the gain circuit 11 to multiply the input vector Cx by a gain Gx, i.e., a scaled input vector) from the gain circuit 11 and a code vector Cy are supplied to an inverse normalizing coefficient calculator 14, and the inverse normalizing coefficient calculator 14 calculates an inverse normalizing coefficient Ny". The gain Gy of the gain circuit 12 is obtained such that a normalized gain Ly is inversely normalized by using the inverse normalizing coefficient Ny" in an inverse normalizing section 15.

In the gain quantization apparatus according to this embodiment, an inverse normalizing coefficient is calculated by using a vector obtained by scaling the first input vector obtained in the current frame, and a normalized vector is inversely normalized on the basis of the inverse normalizing coefficient to calculate of the value of the gain of the second input vector. In this case, since the normalized gain calculated does not change depending on a change in vector output after multiplication of the gain, the information of the normalized gain can be transmitted or stored with a small number of bits. In addition, when the input vector of the current frame is close to the output vector, the inverse normalizing coefficient is calculated by using the input vector of the current frame. Therefore, normalized efficiency is improved in the transition portion of an input signal, and the performance of gain quantization is improved.

This embodiment has an advantage that a gain quantization accuracy higher than that of the fifth embodiment can be obtained when the gain of the gain circuit 11 has a value close to 1.0. This is because, although the inverse normalizing coefficient Ny" is calculated with consideration of the value of the gain circuit 11 as 1.0 in the fifth embodiment, the inverse normalizing coefficient Ny" is calculated after the gain of the gain circuit 11 is considered in the ninth embodiment.

TENTH EMBODIMEMT

Figure 22:
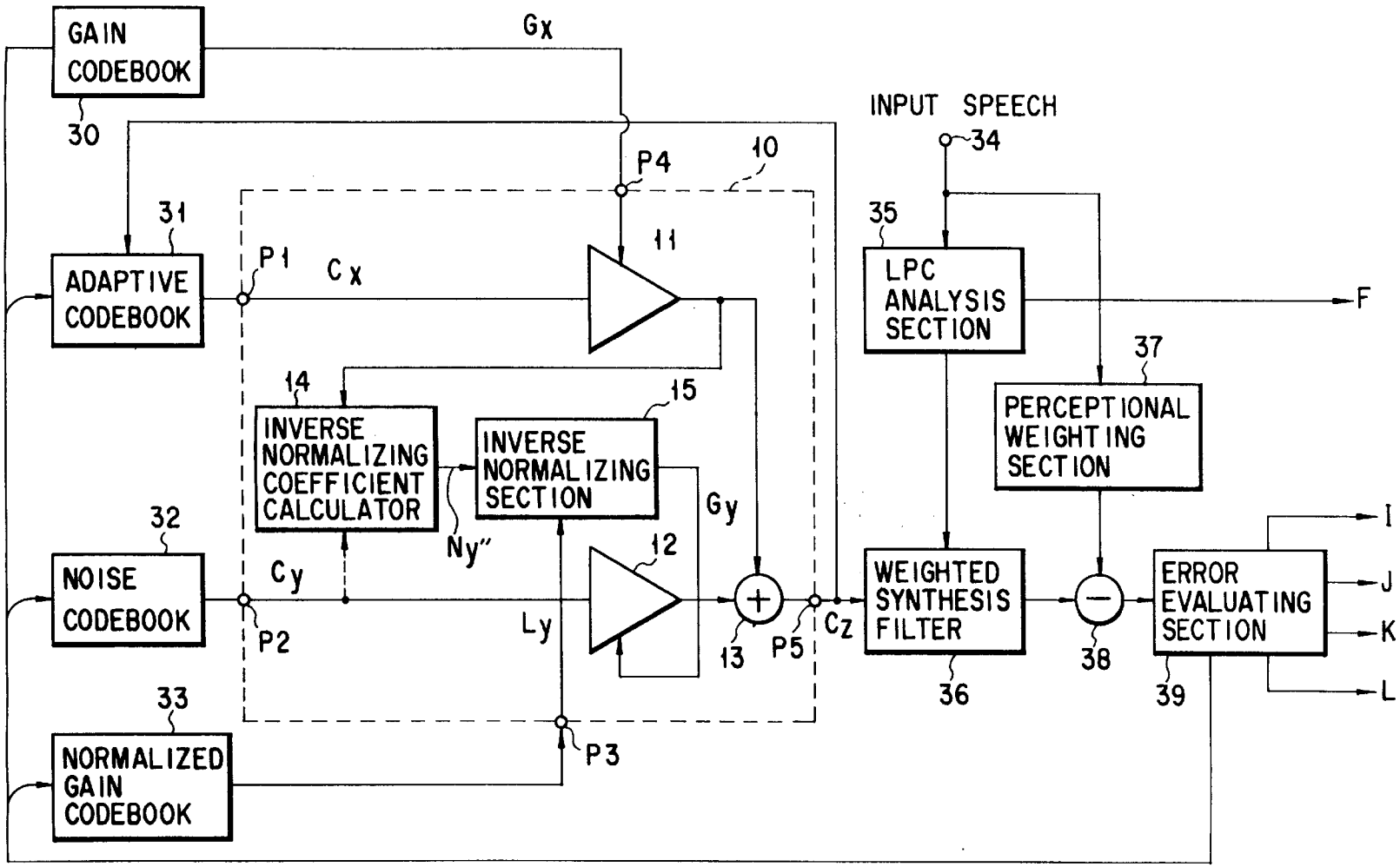
FIG. 22 is a block diagram showing a speech coding apparatus according to the tenth embodiment of the present invention.

FIG. 22 shows an embodiment of a speech coding apparatus using the gain quantization apparatus in FIG. 21.

ELEVENTH EMBODIMENT

Figure 23:
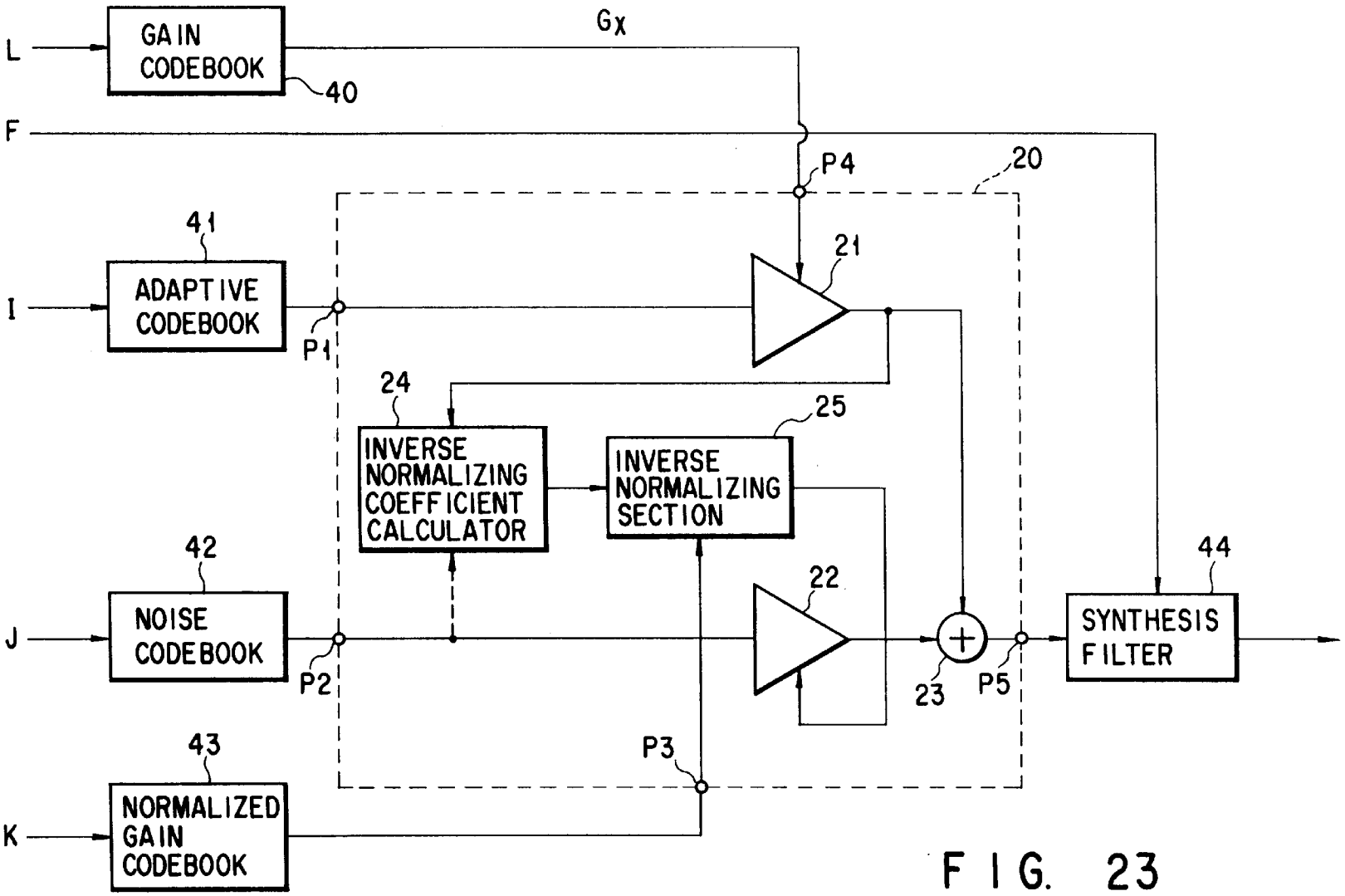
FIG. 23 is a block diagram showing a speech decoding apparatus according to the eleventh embodiment of the present invention.

FIG. 23 shows an embodiment of a speech decoding apparatus using the gain quantization apparatus in FIG. 21.

TWELFTH EMBODIMENT

Figure 24:
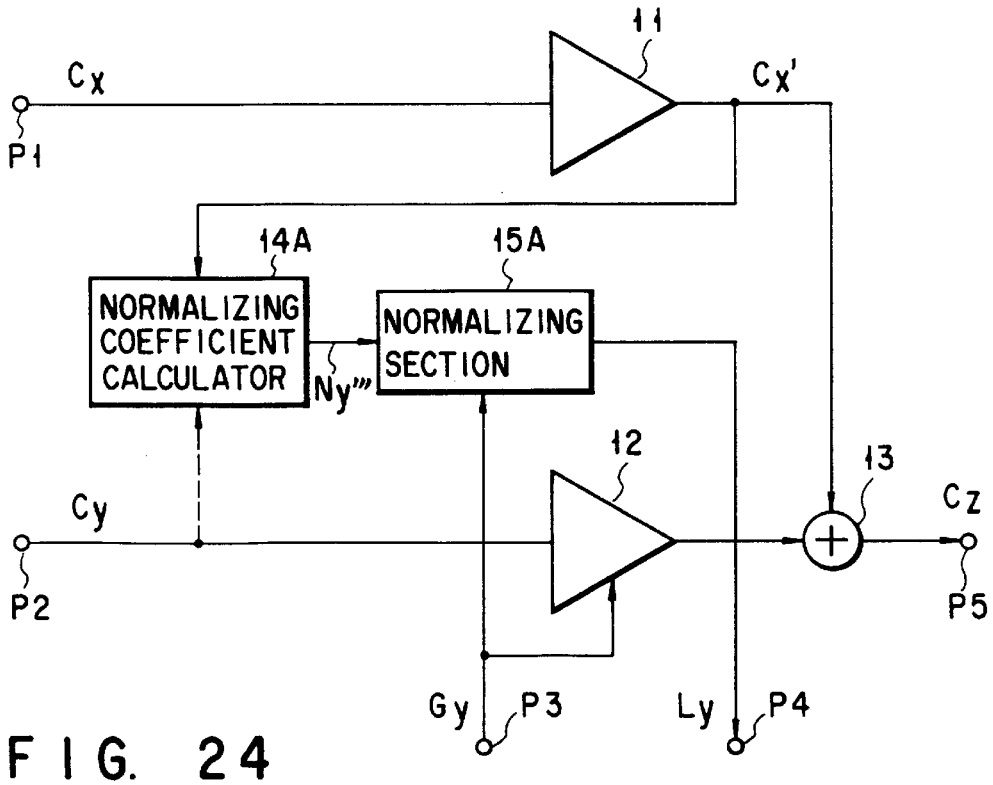
FIG. 24 is a block diagram showing a gain quantization apparatus according to the twelfth embodiment of the present invention.

FIG. 24 shows the arrangement of a gain quantization apparatus according to the twelfth embodiment related to a modification of the fifth embodiment. Code vectors Cx and Cy input to terminals P1 and P2 are multiplied by gains Gx and Gy by means of gain circuits 11 and 12, respectively, and the resultant vectors are synthesized with each other by an adder 13 to be an output vector Cz. The output vector Cz is output from a terminal P5.

An output vector Cx' from circuit 11 and an input vector Cy are supplied to a normalizing coefficient calculator 14A, and the normalizing coefficient calculator 14A calculates a normalizing coefficient Ny'". A normalized gain Ly obtained by causing the normalizing section 15A to normalize the gain Gy of the gain circuit 12 is quantized as need, and the resultant value is transmitted to a transmission path or stored in a storage medium.

As has been described above, according to the present invention, there can be provided a vector quantization apparatus capable of minimizing abrupt quality degradation of a reproduced signal even if a code error is present on a transmission path. The vector quantization apparatus according to the present invention can perform a high-speed index search with a small processing amount even if the number of bits of an index is large, and an equivalently large number of code vectors can be realized as a codebook even if the number of seed vectors stored as a codebook is decreased. Therefore, a memory capacity required to store the seed vectors can be advantageously reduced. In addition, according to the present invention, a normalizing coefficient is calculated by using the first input vector of a current frame, and a gain by which the second input vector is multiplied is normalized. Therefore, quantizing performance, especially in the transition portion of an input signal, is improved compared with a method using the signal of a previous frame to normalize a gain.

The present invention is not limited to the embodiments described above, and various changes and modifications of the present invention can be effected. For example, although each embodiment is independently described above, a plurality of embodiments may be properly combined with each other.

What is claimed is:

1. A speech coding apparatus comprising:

a noise codebook for storing a plurality of noise code vectors which are designated by a noise codebook index;

an adaptive codebook for generating an adaptive code vector based on a pitch information, the adaptive code vector simulating an input speech;

synthesis means for generating a synthesis speech based on the noise code vector read from said noise codebook and the adaptive code vector read from said adaptive codebook; and coding means for searching for the noise codebook index and the pitch information such that a difference between the input speech and the synthesis speech is minimized, thereby coding the input speech by using the noise codebook index and the pitch information, the coding means comprising:

error evaluating means for evaluating the difference with consideration of a code error of the noise codebook index; and means for selecting, on the basis of an evaluation result of said error evaluating means, at least one index from a plurality of indexes candidates each of which can be an index used to express the input speech.

2. A speech coding apparatus according to claim 1, in which said error evaluating means comprises:

input means for inputting code error information on a transmission path for transmitting the noise codebook index; and means for evaluating an error of the difference on the basis of the code error information input by said input means.

3. A speech coding apparatus comprising:

a noise codebook for storing a plurality of noise code vectors which are designated by a noise codebook index;

an adaptive codebook for generating an adaptive code vector based on a pitch information, the adaptive code vector simulating an input speech;

synthesis means for generating a synthesis speech based on the noise code vector read from said noise codebook and the adaptive code vector read from said adaptive codebook; and coding means for searching for the noise codebook index and the pitch information such that a difference between the input speech and the synthesis speech is minimized, thereby coding the input speech by using the noise codebook index and the pitch information, the coding means comprising:

first evaluating means for evaluating the difference without consideration of a code error of the noise codebook index;

second evaluating means for evaluating the difference with consideration of the code error of the noise-codebook index;

first selecting means for selecting, on the basis of an evaluation result of said first evaluating means, a small number of index candidates from a large number of index candidates each of which can be an index used to express the input speech; and second selecting means for selecting, on the basis of an evaluation result of said second evaluating means, at least one index from a small number of index candidates selected by said first selecting means.

4. A speech coding apparatus according to claim 3, in which said second evaluating means comprises:

input means for inputting code error information on a transmission path for transmitting the noise codebook index;

means for evaluating an error of the difference on the basis of the code error information input by said input means.

5. A speech coding apparatus comprising:

a noise codebook for storing a plurality of noise code vectors;

means for setting a polarity of each element of the noise code vectors read from said noise codebook to be one of +1 and −1, thereby generating modified noise code vectors which are larger than the noise code vectors in number;

an adaptive codebook for storing an adaptive code vector which simulates a speech source of an input speech;

synthesis means for synthesizing a modified noise code vector with an adaptive code vector read from said adaptive codebook, said synthesis means updating the adaptive code vector on the basis of a synthesis signal;

means, excited by the synthesis signal, for generating a synthesis speech; and coding means for searching for an index of the noise code vector to be read from said noise codebook and an index of the adaptive code vector to be read from said adaptive codebook such that an error between the input speech and the synthesis speech is minimized, thereby coding both the indexes.

6. A speech coding apparatus according to claim 5, in which said setting means comprises:

means for causing a polarity $s_k$ (k=L(p, n) (k and p are integers which satisfy $0 \leqq k \leqq p-1$ and $1 \leqq p \leqq N$ (positive integer)) of an element $s_n$ of a polarity vector to correspond to a kth bit value $b_k$ of polarity information to generate a p-bit polarity information index;

means for generating an N-dimensional polarity vector on the basis of the polarity information index; and means for generating the modified code vector having, as an element, a product $v_n X s_n$(n=0 to N−1 and $|s_n|=1$) between an element $v_n$ of an N-dimensional seed vector and a corresponding element $s_n$ of the N-dimensional polarity vector.

7. A vector quantization apparatus according to claim 6, in which the function L(p, n) is a remainder obtained by dividing n by p or the maximum integer which does not exceed np/N.

8. A vector quantization apparatus according to claim 6, in which a partial inner product between the target vector and the code vector is calculated with respect to an nth vector element which satisfies a condition k=L(p, n) of the seed vector, and a polarity of the partial inner product is set to be the polarity $s_k$.

9. A speech coding apparatus according to claim 5, in which said setting means comprises:

means for storing a plurality of N-dimensional seed vectors;

searching means for searching for a seed vector index for selecting any one of the plurality of N-dimensional seed vectors;

means for determining a polarity $s_k$ of an element $s_n$ of polarity vector on the basis of polarity information to generate a polarity vector; and means for generating the modified code vector having, as an element, a product between an element of the seed vector selected by said searching means and a corresponding element of the N-dimensional polarity vector.

10. A speech coding apparatus according to claim 5, which said setting means comprises:

means for storing a plurality of N-dimensional seed vectors;

searching means for searching for a seed vector index for selecting any one of the plurality of N-dimensional seed vectors;

means for generating polarity information for designating a polarity of an element $s_n$ of a polarity vector;

means for determining a polarity $s_k$ of an element $s_n$ of the polarity vector on the basis of the polarity information to generate an N-dimensional polarity vector; and means for generating the modified code vector having, as an element, a product between an element of the seed vector selected by said searching means and a corresponding element of the N-dimensional polarity vector, wherein said seed vector index searching means comprises means for decreasing the number of index candidates of the seed vectors to J (0<J<<I) by using a following relationship:

$$cor(i) = \sum_{k=0}^{p-1} |f_k|$$

calculated, when a seed vector Vi (i is a seed vector index and satisfies i=0 to I−1) is used as the seed vector, on the basis of a partial inner product $f_k$ between the target vector and the code vector with respect to an nth vector element which satisfies a condition k=L(p, n) (k and p are integers which satisfy $0 \leqq k \leqq p-1$, $1 \leqq p \leqq N$ (N is an integer)) of the seed vector Vi for each vector Vi.

11. A speech coding apparatus comprising:

a noise codebook for storing a plurality of noise code vectors;

an adaptive codebook for storing an adaptive code vector which simulates a speech source of an input speech;

synthesis means for synthesizing a noise code vector read from said noise codebook with an adaptive code vector read from said adaptive codebook, said synthesis means updating the adaptive code vector stored in said adaptive codebook on the basis of a synthesis signal;

means, excited by the synthesis signal, for generating a synthesis speech; and coding means for searching for an index of the noise code vector to be read from said noise codebook and an index of the adaptive code vector to be read from said adaptive codebook with considering a code error such that an error between the input speech and the synthesis speech is minimized, thereby coding both the indexes.

12. An apparatus according to claim 11, wherein said coding means comprises:

means for pre-selecting a predetermined number of indexes of noise code vectors to be read from said noise code vector without considering a code error such that the error between the input speech and the synthesis speech becomes relatively small; and main selecting means for selecting an index of the noise code vector to be read from said noise codebook with considering the code error such that the error between the input speech and the synthesis speech is minimized.

13. An apparatus according to claim 12, wherein said coding means comprises:

input means for inputting information related to a code error on a transmission path for a code; and means for adjusting the degree of consideration of the code error by said main selecting means depending on the information related to the code error on the transmission path input by said input means.

14. A speech coding apparatus comprising:

a noise codebook for storing a plurality of noise code vectors;

an adaptive codebook for storing an adaptive code vector which simulates a speech source of an input speech;

means multiplying a noise code vector read from said noise codebook by a gain;

a normalized gain codebook for storing a plurality of normalized gain vectors;

means for calculating an inverse normalizing coefficient of the noise code vector read from said noise codebook on the basis of an adaptive code vector read from said adaptive codebook;

means for inversely normalizing a normalized gain vector depending on the inverse normalizing coefficient to calculate a gain by which the noise code vector is multiplied;

synthesis means for synthesizing an adaptive code vector read from said adaptive codebook with a noise code vector which is multiplied by the gain, said synthesis means updating the adaptive code vector on the basis of a synthesis signal;

means, excited by the synthesis signal, for generating a synthesis speech; and coding means for searching for an index of the noise code vector to be read from said noise codebook, an index of the adaptive code vector to be read from said adaptive codebook, and an index of a normalized gain vector to be read from said normalized gain codebook with considering a code error such that an error between the input speech and the synthesis speech is minimized, thereby coding these indexes.

15. A speech coding apparatus comprising:

an adaptive codebook for storing adaptive code vectors;

a noise codebook for storing noise code vectors;

a gain codebook for storing gain vectors;

means for multiplying an adaptive code vector output from the adaptive codebook and a noise code vector output from the noise codebook with respective gain vectors output from the gain codebook;

means for synthesizing the adaptive codebook and the noise codebook which are multiplied with the respective gain vectors to output a synthesized vector as an excitation signal;

a synthesis filter having a filter coefficient determined on the basis of an analysis result of an input speech signal in units of frames, the synthesis filter receiving the excitation signal and outputting a synthesis speech;

means for searching for the adaptive codebook, the noise codebook, and the gain codebook to output such an adaptive code vector, a noise code vector, and a gain code vector that minimize a difference between the synthesis speech and a perceptional weighted signal of the input speech signal;

means for outputting the adaptive code vector, the noise code vector, the gain vector output from said gain codebook, and the filter coefficient of said synthesis filter as coding parameters respectively representing the adaptive code vector, the noise code vector, the gain vector, and the filter coefficient;

calculating means for calculating an inverse normalizing coefficient by using the adaptive code vector of a current frame obtained from said adaptive codebook;

inverse normalizing means for inversely normalizing a normalized gain by using the inverse normalizing coefficient calculated by said calculating means to obtain a gain by which the second vector is multiplied; and means for outputting the normalized gain as a coding parameter.

16. A method for coding speech comprising the steps of:

storing a plurality of noise code vectors in a noise codebook, wherein said noise code vectors are designated by a noise codebook index;

generating an adaptive code vector by an adaptive codebook, wherein said adaptive code vector is based on a pitch information, and wherein said adaptive code vector simulates an input speech;

generating a synthesis speech based on the noise code vector read from said noise codebook and the adaptive code vector read from said adaptive codebook; and searching for the noise codebook index and the pitch information such that a difference between the input speech and the synthesis speech is minimized, thereby coding the input speech by using the noise codebook index and the pitch information, the searching step further comprising:

evaluating the difference with consideration of a code error of the noise codebook index; and selecting, on the basis of an evaluation result of said error evaluating means, at least one index from a plurality of indexes candidates each of which can be an index used to express the input speech.

17. A method for coding speech comprising the steps of:

storing a plurality of noise code vectors in a noise codebook;

setting a polarity of each element of the noise code vectors read from said noise codebook to be one of +1 and −1, thereby generating modified noise code vectors which are larger than the noise code vectors in number;

storing an adaptive code vector in an adaptive codebook, wherein said adaptive code vector simulates a speech source of an input speech;

synthesizing a modified noise code vector with an adaptive code vector read from said adaptive codebook, said synthesizing step updating the adaptive code vector on the basis of a synthesis signal;

generating a synthesis speech in response to said synthesis signal; and searching for an index of the noise code vector to be read from said noise codebook and an index of the adaptive code vector to be read from said adaptive codebook such that an error between the input speech and the synthesis speech is minimized, thereby coding both the indexes.

18. A method for coding speech comprising the steps of:

storing adaptive code vectors in an adaptive codebook;

storing noise code vectors in a noise codebook;

storing gain vectors in a gain codebook;

multiplying an adaptive code vector output from the adaptive codebook and a noise code vector output from the noise codebook with respective gain vectors output from the gain codebook;

synthesizing the adaptive codebook and the noise codebook which are multiplied with the respective gain vectors to output a synthesized vector as an excitation signal;

determining a filter coefficient by a synthesis filter, wherein said filter coefficient is determined on the basis of an analysis result of an input speech signal in units of frames, and wherein said synthesis filter receives the excitation signal and outputs a synthesis speech;

searching for the adaptive codebook, the noise codebook, and the gain codebook to output such an adaptive code vector, a noise code vector, and a gain code vector that minimize a difference between the synthesis speech and a perceptional weighted signal of the input speech signal;

outputting the adaptive code vector, the noise code vector, the gain vector output from said gain codebook, and the filter coefficient of said synthesis filter as coding parameters respectively representing the adaptive code vector, the noise code vector, the gain vector, and the filter coefficient;

calculating an inverse normalizing coefficient by using the adaptive code vector of a current frame obtained from said adaptive codebook;

inversely normalizing a normalized gain by using the inverse normalizing coefficient calculated by said calculating means to obtain a gain by which the second vector is multiplied; and outputting the normalized gain as a coding parameter.

* * * * *